US010165912B2

(12) United States Patent
Conrad

(10) Patent No.: US 10,165,912 B2
(45) Date of Patent: Jan. 1, 2019

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 466 days.

(21) Appl. No.: 15/076,060

(22) Filed: Mar. 21, 2016

(65) Prior Publication Data

US 2016/0198914 A1 Jul. 14, 2016

Related U.S. Application Data

(60) Continuation-in-part of application No. 14/822,211, filed on Aug. 10, 2015, now Pat. No. 9,888,817, and
(Continued)

(51) Int. Cl.
*A47L 5/24* (2006.01)
*A47L 5/22* (2006.01)
(Continued)

(52) U.S. Cl.
CPC ..... *A47L 5/225* (2013.01); *A47L 5/24* (2013.01); *A47L 5/28* (2013.01); *A47L 9/1625* (2013.01);
(Continued)

(58) Field of Classification Search
CPC ... A47L 5/24; A47L 5/28; A47L 5/225; A47L 9/1625; A47L 9/1683; A47L 9/1691;
(Continued)

(56) References Cited

U.S. PATENT DOCUMENTS 911,258 A 2/1909 Neumann
1,600,762 A 9/1926 Hawley
(Continued)

FOREIGN PATENT DOCUMENTS

AU 112778 4/1940
CA 1077412 A1 5/1980
(Continued)

OTHER PUBLICATIONS

International Preliminary Examination Report on International application No. PCT/CA2015/051332, dated Mar. 7, 2016.
(Continued)

*Primary Examiner* — David Redding
(74) *Attorney, Agent, or Firm* — Philip C. Mendes da Costa; Bereskin & Parr LLP/S.E.N.C.R.L., s.r.l.

(57) ABSTRACT

A surface cleaning apparatus comprises a surface cleaning head, an upright section moveably mounted to the surface cleaning head, and a portable cleaning unit removably mounted to the upright section and comprising an energy storage member and a portable cleaning unit suction motor. The energy storage member provides the portable cleaning unit suction motor with power at least when the portable cleaning unit is switched on and when the portable cleaning unit is removed from the upright section.

8 Claims, 28 Drawing Sheets

Related U.S. Application Data a continuation-in-part of application No. 14/875,381, filed on Oct. 5, 2015, now Pat. No. 9,545,181, which is a continuation of application No. 13/782,217, filed on Mar. 1, 2013, now Pat. No. 9,192,269, which is a continuation-in-part of application No. 13/720,754, filed on Dec. 19, 2012, now Pat. No. 8,752,239, which is a division of application No. 11/954,331, filed on Dec. 12, 2007, now Pat. No. 8,359,705.

(60) Provisional application No. 62/093,189, filed on Dec. 17, 2014, provisional application No. 60/884,767, filed on Jan. 12, 2007, provisional application No. 60/870,175, filed on Dec. 15, 2006.

(51) Int. Cl.

| | |
|---|---|
| ***A47L 9/28*** | (2006.01) |
| ***A47L 5/28*** | (2006.01) |
| ***A47L 9/16*** | (2006.01) |
| ***A47L 9/32*** | (2006.01) |

(52) U.S. Cl.

CPC ..... *A47L 9/1683* (2013.01); *A47L 9/1691* (2013.01); *A47L 9/2868* (2013.01); *A47L 9/2878* (2013.01); *A47L 9/2884* (2013.01); *A47L 9/325* (2013.01)

(58) Field of Classification Search

CPC ..... A47L 9/325; A47L 9/2884; A47L 9/2868; A47L 9/2878

USPC ..... 15/329, 331, DIG. 1

IPC ..... A47L 5/24

See application file for complete search history.

(56) References Cited

U.S. PATENT DOCUMENTS

| | | | |
|---|---|---|---|
| 1,797,812 | A | 3/1931 | Waring |
| 1,898,608 | A | 2/1933 | Alexander |
| 1,937,765 | A | 12/1933 | Leathers |
| 2,015,464 | A | 9/1935 | Saint-Jacques |
| 2,152,114 | A | 3/1939 | Tongeren |
| 2,542,634 | A | 2/1951 | Davis |
| 2,678,110 | A | 5/1954 | Madsen |
| 2,731,102 | A | 1/1956 | James |
| 2,811,219 | A | 10/1957 | Wenzl |
| 2,846,024 | A | 8/1958 | Bremi |
| 2,913,111 | A | 11/1959 | Rogers |
| 2,917,131 | A | 12/1959 | Evans |
| 2,937,713 | A | 5/1960 | Stephenson et al. |
| 2,942,691 | A | 6/1960 | Dillon |
| 2,942,692 | A | 6/1960 | Benz |
| 2,946,451 | A | 7/1960 | Culleton |
| 2,952,330 | A | 9/1960 | Winslow |
| 2,981,369 | A | 4/1961 | Yellott et al. |
| 3,032,954 | A | 5/1962 | Racklyeft |
| 3,085,221 | A | 4/1963 | Francis |
| 3,130,157 | A | 4/1964 | Kelsall et al. |
| 3,200,568 | A | 8/1965 | McNeil |
| 3,204,772 | A | 9/1965 | Ruxton |
| 3,217,469 | A | 11/1965 | Eckert |
| 3,269,097 | A | 8/1966 | German |
| 3,320,727 | A | 5/1967 | Farley |
| 3,372,532 | A | 3/1968 | Campbell |
| 3,426,513 | A | 2/1969 | Bauer |
| 3,518,815 | A | 7/1970 | Peterson et al. |
| 3,530,649 | A | 9/1970 | Porsch et al. |
| 3,543,325 | A | 12/1970 | Hamrick |
| 3,561,824 | A | 2/1971 | Homan |
| 3,582,616 | A | 6/1971 | Wrob |
| 3,684,093 | A | 5/1972 | Kono |
| 3,675,401 | A | 7/1972 | Cordes |
| 3,822,533 | A | 7/1974 | Oranje |
| 3,898,068 | A | 8/1975 | McNeil et al. |
| 3,933,450 | A | 1/1976 | Percevaut |
| 3,988,132 | A | 10/1976 | Oranje |
| 3,988,133 | A | 10/1976 | Schady |
| 4,097,381 | A | 6/1978 | Ritzler |
| 4,187,088 | A | 2/1980 | Hodgson |
| 4,218,805 | A | 8/1980 | Brazier |
| 4,236,903 | A | 12/1980 | Malmsten |
| 4,307,485 | A | 12/1981 | Dessig |
| 4,373,228 | A | 2/1983 | Dyson |
| 4,382,804 | A | 5/1983 | Mellor |
| 4,409,008 | A | 10/1983 | Solymes |
| 4,486,207 | A | 12/1984 | Baillie |
| 4,494,270 | A | 1/1985 | Ritzau et al. |
| 4,523,936 | A | 6/1985 | Disanza, Jr. |
| 4,678,588 | A | 7/1987 | Shortt |
| 4,700,429 | A | 10/1987 | Martin et al. |
| 4,744,958 | A | 5/1988 | Pircon |
| 4,778,494 | A | 10/1988 | Patterson |
| 4,826,515 | A | 5/1989 | Dyson |
| D303,173 | S | 8/1989 | Miyamoto et al. |
| 4,853,008 | A | 8/1989 | Dyson |
| 4,853,011 | A | 8/1989 | Dyson |
| 4,853,111 | A | 8/1989 | MacArthur et al. |
| 4,900,270 | A | 2/1990 | Edwards et al. |
| 4,905,342 | A | 3/1990 | Ataka |
| 4,944,780 | A | 7/1990 | Usmani |
| 4,980,945 | A | 1/1991 | Bewley |
| 5,054,157 | A | 10/1991 | Werner et al. |
| 5,080,697 | A | 1/1992 | Finke |
| 5,090,976 | A | 2/1992 | Dyson |
| 5,129,125 | A | 7/1992 | Gamou et al. |
| 5,224,238 | A | 7/1993 | Barlett |
| 5,230,722 | A | 7/1993 | Yonkers |
| 5,254,019 | A | 10/1993 | Noschese |
| 5,267,371 | A | 12/1993 | Soler et al. |
| 5,287,591 | A | 2/1994 | Rench et al. |
| 5,307,538 | A | 5/1994 | Rench et al. |
| 5,309,600 | A | 5/1994 | Weaver et al. |
| 5,309,601 | A | 5/1994 | Hampton et al. |
| 5,347,679 | A | 9/1994 | Saunders et al. |
| 5,363,535 | A | 11/1994 | Rench et al. |
| 5,466,172 | A | 11/1995 | Carstens et al. |
| 5,481,780 | A | 1/1996 | Daneshvar |
| 5,515,573 | A | 5/1996 | Frey |
| 5,599,365 | A | 2/1997 | Alday et al. |
| D380,033 | S | 6/1997 | Theiss et al. |
| 5,704,400 | A | 1/1998 | Eldridge |
| 5,709,007 | A | 1/1998 | Chiang |
| 5,755,096 | A | 5/1998 | Holleyman |
| 5,815,878 | A | 10/1998 | Murakami et al. |
| 5,815,881 | A | 10/1998 | Sjogreen |
| 5,858,038 | A | 1/1999 | Dyson et al. |
| 5,858,043 | A | 1/1999 | Geise |
| 5,893,938 | A | 4/1999 | Dyson et al. |
| 5,935,279 | A | 8/1999 | Kilstrom |
| 5,941,729 | A | 8/1999 | Sri-Jayantha |
| 5,950,274 | A | 9/1999 | Kilstrom |
| 5,970,572 | A | 10/1999 | Homas |
| 6,071,095 | A | 6/2000 | Verkaart |
| 6,071,321 | A | 6/2000 | Trapp et al. |
| 6,080,022 | A | 6/2000 | Shaberman et al. |
| 6,094,775 | A | 8/2000 | Behmer |
| 6,122,796 | A | 9/2000 | Downham et al. |
| 6,210,469 | B1 | 4/2001 | Tokar |
| 6,221,134 | B1 | 4/2001 | Conrad et al. |
| 6,228,260 | B1 | 5/2001 | Conrad et al. |
| 6,231,645 | B1 | 5/2001 | Conrad et al. |
| 6,251,296 | B1 | 6/2001 | Conrad et al. |
| 6,260,234 | B1 | 7/2001 | Wright et al. |
| 6,295,692 | B1 | 10/2001 | Shideler |
| 6,345,408 | B1 | 2/2002 | Nagai et al. |
| 6,406,505 | B1 | 6/2002 | Oh et al. |
| 6,434,785 | B1 | 8/2002 | Vandenbelt et al. |
| 6,440,197 | B1 | 8/2002 | Conrad et al. |
| D466,867 | S | 12/2002 | Krobusek |
| 6,500,025 | B1 | 12/2002 | Moenkhaus et al. |
| 6,502,278 | B2 | 1/2003 | Oh et al. |
| 6,519,810 | B2 | 2/2003 | Kim |

(56) References Cited

U.S. PATENT DOCUMENTS 6,531,066 B1 3/2003 Saunders et al.
6,536,072 B2 3/2003 Thur et al.
6,540,549 B2 4/2003 Rupert
6,553,612 B1 4/2003 Dyson et al.
6,553,613 B2 4/2003 Onishi et al.
6,560,818 B1 5/2003 Hasko
6,581,239 B1 6/2003 Dyson et al.
6,599,338 B2 7/2003 Oh et al.
6,599,350 B1 7/2003 Rockwell et al.
6,613,316 B2 9/2003 Sun et al.
6,623,539 B2 9/2003 Lee et al.
6,625,845 B2 9/2003 Matsumoto et al.
6,640,385 B2 11/2003 Oh et al.
6,648,934 B2 11/2003 Choi et al.
6,712,868 B2 3/2004 Murphy et al.
6,732,403 B2 5/2004 Moore et al.
6,746,500 B1 6/2004 Park et al.
6,782,583 B2 8/2004 Oh
6,782,585 B1 8/2004 Conrad et al.
6,810,558 B2 11/2004 Lee
6,818,036 B1 11/2004 Seaman
6,833,015 B2 12/2004 Oh et al.
6,868,578 B1 3/2005 Kasper et al.
6,874,197 B1 4/2005 Conrad
6,896,719 B2 5/2005 Coates et al.
6,929,516 B2 8/2005 Brochu et al.
6,962,506 B1 11/2005 Krobusek
6,968,596 B2 11/2005 Oh et al.
6,976,885 B2 12/2005 Lord
7,113,847 B2 9/2006 Chmura et al.
7,128,770 B2 10/2006 Oh et al.
7,160,346 B2 1/2007 Park
7,162,770 B2 1/2007 Davidshofer
7,175,682 B2 2/2007 Nakai et al.
7,188,388 B2 3/2007 Best et al.
7,198,656 B2 4/2007 Takemoto et al.
7,222,393 B2 5/2007 Kaffenberger et al.
7,272,872 B2 9/2007 Choi
7,278,181 B2 10/2007 Harris et al.
7,341,611 B2 3/2008 Greene et al.
7,354,468 B2 4/2008 Arnold et al.
7,370,387 B2 5/2008 Walker et al.
7,377,007 B2 5/2008 Best
7,377,953 B2 5/2008 Oh
7,386,915 B2 6/2008 Blocker et al.
7,395,579 B2 7/2008 Oh
7,426,768 B2 9/2008 Peterson et al.
7,429,284 B2 9/2008 Oh
7,448,363 B1 11/2008 Rasmussen et al.
7,449,040 B2 11/2008 Conrad et al.
7,485,164 B2 2/2009 Jeong et al.
7,488,363 B2 2/2009 Jeong et al.
7,547,337 B2 6/2009 Oh et al.
7,547,338 B2 6/2009 Kim et al.
7,563,298 B2 7/2009 Oh
7,565,853 B2 7/2009 Arnold et al.
7,588,616 B2 9/2009 Conrad et al.
7,597,730 B2 10/2009 Yoo et al.
7,628,831 B2 12/2009 Gomiciaga-Pereda et al.
7,740,676 B2 6/2010 Burnham et al.
7,770,256 B1 8/2010 Fester
7,776,120 B2 8/2010 Conrad
7,779,506 B2 8/2010 Kang et al.
7,798,845 B1 9/2010 Buchanan
7,803,207 B2 9/2010 Conrad
7,805,804 B2 10/2010 Loebig
7,811,349 B2 10/2010 Nguyen
7,867,308 B2 1/2011 Conrad
7,922,794 B2 4/2011 Morphey
7,931,716 B2 4/2011 Oakham
7,938,871 B2 5/2011 Llyod
7,979,959 B2 7/2011 Courtney
8,021,453 B2 9/2011 Howes
8,062,398 B2 11/2011 Luo et al.
8,078,761 B2 12/2011 Cardina et al.
8,117,712 B2 2/2012 Dyson et al.
8,146,201 B2 4/2012 Conrad
8,151,407 B2 4/2012 Conrad
8,152,877 B2 4/2012 Greene
8,156,609 B2 4/2012 Milne et al.
8,161,599 B2 4/2012 Griffith et al.
8,225,456 B2 7/2012 Hakan et al.
8,484,799 B2 7/2013 Conrad
8,673,487 B2 3/2014 Churchill
8,834,209 B2 9/2014 Conrad
9,192,269 B2 11/2015 Conrad
2002/0011053 A1 1/2002 Oh
2002/0062531 A1 5/2002 Oh
2002/0088208 A1 7/2002 Lukac et al.
2002/0112315 A1 8/2002 Conrad
2002/0134059 A1 9/2002 Oh
2002/0178535 A1 12/2002 Oh et al.
2002/0178698 A1 12/2002 Oh et al.
2002/0178699 A1 12/2002 Oh
2003/0046910 A1 3/2003 Lee
2003/0066273 A1 4/2003 Choi et al.
2003/0106180 A1 6/2003 Tsen
2003/0159238 A1 8/2003 Oh
2003/0159411 A1 8/2003 Hansen et al.
2003/0200736 A1 10/2003 Ni
2004/0010885 A1 1/2004 Hitzelberger et al.
2004/0025285 A1 2/2004 McCormick et al.
2004/0088817 A1 5/2004 Cochran et al.
2004/0216263 A1 11/2004 Best et al.
2004/0216264 A1 11/2004 Shaver et al.
2005/0081321 A1 4/2005 Milligan et al.
2005/0115409 A1 6/2005 Conrad
2005/0132528 A1 6/2005 Yau
2005/0198769 A1 9/2005 Lee et al.
2005/0198770 A1 9/2005 Jung et al.
2005/0252179 A1 11/2005 Oh et al.
2005/0252180 A1 11/2005 Oh et al.
2006/0037172 A1 2/2006 Choi
2006/0090290 A1 5/2006 Lau
2006/0042206 A1 6/2006 Arnold et al.
2006/0123590 A1 6/2006 Fester et al.
2006/0137304 A1 6/2006 Jeong et al.
2006/0137306 A1 6/2006 Jeong et al.
2006/0137309 A1 6/2006 Jeong et al.
2006/0137314 A1 6/2006 Conrad et al.
2006/0156508 A1 7/2006 Khalil
2006/0162298 A1 7/2006 Oh et al.
2006/0162299 A1 7/2006 North
2006/0168922 A1 8/2006 Oh
2006/0168923 A1 8/2006 Lee et al.
2006/0207055 A1 9/2006 Ivarsson et al.
2006/0207231 A1 9/2006 Arnold
2006/0230715 A1 10/2006 Oh et al.
2006/0230723 A1 10/2006 Kim et al.
2006/0230724 A1 10/2006 Han et al.
2006/0236663 A1 10/2006 Oh
2006/0254226 A1 11/2006 Jeon
2006/0278081 A1 12/2006 Han et al.
2006/0288516 A1 12/2006 Sawalski
2007/0077810 A1 4/2007 Gogel
2007/0079473 A1 4/2007 Min
2007/0079585 A1 4/2007 Oh et al.
2007/0095028 A1 5/2007 Kim
2007/0095029 A1 5/2007 Min
2007/0136984 A1 6/2007 Hsu
2007/0209334 A1 9/2007 Conrad
2007/0209335 A1 9/2007 Conrad
2007/0271724 A1 11/2007 Hakan et al.
2007/0289089 A1 12/2007 Yacobi
2007/0289266 A1 12/2007 Oh
2008/0040883 A1 2/2008 Beskow et al.
2008/0047091 A1 2/2008 Nguyen
2008/0057780 A1 3/2008 O'Rourke
2008/0134460 A1 6/2008 Conrad
2008/0134462 A1 6/2008 Jansen et al.
2008/0178416 A1 7/2008 Conrad
2008/0178420 A1 7/2008 Conrad
2008/0190080 A1 8/2008 Conrad
2008/0196194 A1 8/2008 Conrad

(56) References Cited

U.S. PATENT DOCUMENTS

| | | | |
|---|---|---|---|
| 2008/0301903 | A1 | 12/2008 | Cunningham et al. |
| 2009/0067944 | A1 | 3/2009 | Motta et al. |
| 2009/0100633 | A1 | 4/2009 | Jeon |
| 2009/0113659 | A1 | 5/2009 | Jeon |
| 2009/0144932 | A1 | 6/2009 | Yoo |
| 2009/0165431 | A1 | 7/2009 | Oh |
| 2009/0205160 | A1 | 8/2009 | Conrad |
| 2009/0205161 | A1 | 8/2009 | Conrad |
| 2009/0205298 | A1 | 8/2009 | Hyun et al. |
| 2009/0209666 | A1 | 8/2009 | Hellberg et al. |
| 2009/0265877 | A1 | 10/2009 | Dyson et al. |
| 2009/0282639 | A1 | 11/2009 | Dyson et al. |
| 2009/0300874 | A1 | 12/2009 | Tran et al. |
| 2009/0300875 | A1 | 12/2009 | Inge et al. |
| 2009/0307564 | A1 | 12/2009 | Vedantham et al. |
| 2009/0307863 | A1 | 12/2009 | Milne et al. |
| 2009/0307864 | A1 | 12/2009 | Dyson |
| 2009/0308254 | A1 | 12/2009 | Oakham |
| 2009/0313958 | A1 | 12/2009 | Gomiciaga-Pereda et al. |
| 2009/0313959 | A1 | 12/2009 | Gomiciaga-Pereda et al. |
| 2010/0083459 | A1 | 4/2010 | Beskow et al. |
| 2010/0132319 | A1 | 6/2010 | Ashbee et al. |
| 2010/0154150 | A1 | 6/2010 | Mcleod |
| 2010/0175217 | A1 | 7/2010 | Conrad |
| 2010/0197157 | A1 | 8/2010 | Wang |
| 2010/0212104 | A1 | 8/2010 | Conrad |
| 2010/0224073 | A1 | 9/2010 | Oh et al. |
| 2010/0229321 | A1 | 9/2010 | Dyson et al. |
| 2010/0229328 | A1 | 9/2010 | Conrad |
| 2010/0242210 | A1 | 9/2010 | Conrad |
| 2010/0243158 | A1 | 9/2010 | Conrad |
| 2010/0293745 | A1 | 11/2010 | Coburn |
| 2010/0299865 | A1 | 12/2010 | Conrad |
| 2010/0299866 | A1 | 12/2010 | Conrad |
| 2011/0023261 | A1 | 2/2011 | Proffitt, II et al. |
| 2011/0146024 | A1 | 6/2011 | Conrad |
| 2011/0168332 | A1 | 7/2011 | Bowe et al. |
| 2012/0060322 | A1 | 3/2012 | Simonelli et al. |
| 2012/0216361 | A1 | 8/2012 | Millington et al. |
| 2012/0222245 | A1 | 9/2012 | Conrad |
| 2012/0222260 | A1 | 9/2012 | Conrad |
| 2012/0222262 | A1 | 9/2012 | Conrad |
| 2014/0137362 | A1 | 5/2014 | Smith |
| 2014/0137363 | A1 | 5/2014 | Wilson |
| 2014/0137364 | A1 | 5/2014 | Stickney et al. |
| 2014/0182080 | A1 | 7/2014 | Lee et al. |
| 2014/0208538 | A1 | 7/2014 | Visel et al. |

FOREIGN PATENT DOCUMENTS

| | | | |
|---|---|---|---|
| CA | 1218962 | A | 3/1987 |
| CA | 2450450 | A1 | 12/2004 |
| CA | 2484587 | A1 | 4/2005 |
| CA | 2438079 | C | 8/2009 |
| CA | 2659212 | A1 | 9/2010 |
| CN | 1493244 | A | 5/2004 |
| CN | 1887437 | A | 1/2007 |
| CN | 202932850 | U | 5/2013 |
| DE | 875134 | C | 4/1953 |
| DE | 9216071 | U1 | 2/1993 |
| DE | 4232382 | C1 | 3/1994 |
| EP | 493950 | A2 | 7/1992 |
| EP | 1200196 | B1 | 6/2005 |
| EP | 1779761 | A2 | 5/2007 |
| EP | 1815777 | A1 | 8/2007 |
| EP | 1594386 | B1 | 4/2009 |
| EP | 1676516 | B1 | 1/2010 |
| EP | 2308360 | A2 | 4/2011 |
| EP | 1629758 | B1 | 10/2013 |
| EP | 2848173 | A1 | 3/2015 |
| FR | 2812531 | B1 | 11/2004 |
| GB | 100791 | A | 12/1953 |
| GB | 1111074 | A | 4/1968 |
| GB | 2035787 | B | 10/1982 |
| GB | 2126471 | * | 3/1984 |
| GB | 2163703 | B | 1/1988 |
| GB | 2268875 | A | 1/1994 |
| GB | 2307849 | A | 6/1997 |
| GB | 2282979 | B | 10/1997 |
| GB | 2365324 | B | 7/2002 |
| GB | 2441962 | B | 3/2011 |
| GB | 2466290 | B | 10/2012 |
| GB | 2508035 | A | 5/2014 |
| JP | 61131720 | A | 6/1986 |
| JP | 2000140533 | A | 5/2000 |
| JP | 2010178773 | A | 8/2010 |
| JP | 2010220632 | A | 10/2010 |
| JP | 2011189132 | A | 9/2011 |
| JP | 2011189133 | A | 9/2011 |
| WO | 1980002561 | A1 | 11/1980 |
| WO | 9627446 | A1 | 9/1996 |
| WO | 9720492 | A1 | 6/1997 |
| WO | 9809121 | A1 | 3/1998 |
| WO | 9843721 | A1 | 10/1998 |
| WO | 0107168 | A1 | 2/2001 |
| WO | 2004069021 | A1 | 8/2004 |
| WO | 2006026414 | A3 | 8/2007 |
| WO | 2008009883 | A1 | 1/2008 |
| WO | 2008009888 | A1 | 1/2008 |
| WO | 2008009890 | A1 | 1/2008 |
| WO | 2008009891 | A1 | 1/2008 |
| WO | 2008088278 | A2 | 7/2008 |
| WO | 2009026709 | A1 | 3/2009 |
| WO | 2010102396 | A1 | 9/2010 |
| WO | 2010142968 | A1 | 12/2010 |
| WO | 2010142969 | A1 | 12/2010 |
| WO | 2010142970 | A1 | 12/2010 |
| WO | 2010142971 | A | 12/2010 |
| WO | 2011054106 | A1 | 5/2011 |
| WO | 2012042240 | A1 | 4/2012 |
| WO | 2012117231 | A1 | 9/2012 |

OTHER PUBLICATIONS

International Search Report and Written Opinion received in connection to International Patent Application No. PCT/CA2007/002211, dated Apr. 21, 2008.

Euro-Pro Shark Cordless Hand Vac Owner's Manual, Published in 2002.

United States Office Action, dated Jul. 22, 2010, for U.S. Appl. No. 11/953,292.

United States Office Action, dated Feb. 16, 2011, for U.S. Appl. No. 11/953,292.

International Search Report and Written Opinion received in connection to International Patent Application No. PCT/CA2015/050661, dated Oct. 19, 2015.

Office Action dated Jul. 7, 2010, for Canadian Patent Application No. 2,675,714.

International Preliminary Examination Report on International Application No. PCT/CA00/00873, dated Oct. 26, 2001.

European Communication pursuant to Article 94(3) on European Patent Application No. 04078261.7, dated Feb. 26, 2010.

European Communication pursuant to Article 94(3) on European Patent Application No. 04078261.7, dated Apr. 24, 2012.

Makita BCL180 User Manual.

Makita 4071 Handy Vac II Cordless Cleaner.

Handbook of Air Pollution Prevention and Control, pp. 397-404, 2002.

The Office Action received in connection to the related Chinese Patent Application No. 00813438.3 dated Jul. 11, 2003.

The Office Action received in connection to the corresponding U.S. Appl. No. 12/720,901 dated Jun. 10, 2011.

The Office Action Received in connection to the Ccorresponding Chinese Patent Application No. 200880126486.6 dated Mar. 23, 2012.

Supplementary European Search Report, dated Jun. 16, 2009, as received on the corresponding EP Application No. 07719394.4.

International Preliminary Report on International Application No. PCY/CA2007/000380, dated Jul. 24, 2007.

(56) References Cited

OTHER PUBLICATIONS

Office Action, issued in U.S. Appl. No. 12/720,901, dated Nov. 26, 2010.
International Search Report and Written Opinion received in connection to International Patent Application No. PCT/CA2014/00133, dated May 26, 2014.

* cited by examiner

SURFACE CLEANING APPARATUS

CROSS-REFERENCES TO RELATED APPLICATIONS

This application claims the benefit under 35 USC 120 as:
(a) a continuation-in-part of U.S. patent application Ser. No. 14/822,211, which was filed on Aug. 10, 2015 and which itself claims priority from U.S. Provisional Patent Application 62/093,189 which was filed on Dec. 17, 2014;
(b) as continuation-in-part of U.S. patent application Ser. No. 14/875,381, which was filed on Oct. 5, 2015 and which itself is continuation of U.S. patent application Ser. No. 13/782,217 which was filed on Mar. 1, 2013 and which issued as U.S. Pat. No. 9,192,269 on Nov. 24, 2015, which itself is a continuation-in-part of U.S. patent application Ser. No. 13/720,754 which was filed on Dec. 19, 2012 and which issued as U.S. Pat. No. 8,752,239 on May 2, 2013, which itself is a divisional application of U.S. patent application Ser. No. 11/954,331 which was filed on Dec. 12, 2007 which issued as U.S. Pat. No. 8,359,705 on Jan. 29, 2013, which itself claims priority from U.S. Provisional Patent applications 60/870,175 (filed on Dec. 15, 2006), and 60/884,767 (filed on Jan. 12, 2007), all of which are incorporated herein by reference in their entirety.

FIELD

This specification relates to a surface cleaning apparatus comprising a base with a removable portable surface cleaning unit such as a pod or other hand carriable surface cleaning apparatus wherein the portable surface cleaning apparatus is usable when mounted on the base or when removed therefrom.

INTRODUCTION

The following is not an admission that anything discussed below is part of the prior art or part of the common general knowledge of a person skilled in the art.

Various types of surface cleaning apparatuses are known in the art. Such surface cleaning apparatuses include vacuum cleaners, including upright vacuum cleaners, hand carriable vacuum cleaners, canister type vacuum cleaners, and Shop-Vac™ type vacuum cleaners. Some such vacuum cleaners are provided with wheels. For example, typical upright vacuum cleaners are provided with a surface cleaning head that includes wheels mounted to a bottom surface thereof. Upright vacuum cleaners are easy for a consumer to use since the consumer does not have to carry the vacuum cleaner but merely push it over a surface. However, depending on the size of the surface cleaning head, an upright vacuum cleaner may not be useable in smaller or crowded areas. Canister vacuum cleaners have a flexibly hose extending between a surface cleaning head and the canister body, thereby improving mobility of the cleaning head. However, consumers must separately move a canister body, which can add an extra step during the cleaning process.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

According to one broad aspect of this invention, a surface cleaning apparatus comprises a portable cleaning unit, which may be carried by hand or a shoulder strap such as a pod or handvac (hand vacuum cleaner), which is removably mounted on an upright section that is moveably mounted to a surface cleaning head between a storage position and a reclined in use position. The upright section may be an up flow duct or conduit which is rigid and suitable to support the pod or handvac. The portable cleaning unit may be provided with a suction motor (a portable cleaning unit suction motor) and an energy storage member (such as one or more battery). Accordingly, the suction motor of the portable cleaning unit may be operable on DC current. However, in accordance with this embodiment, the surface cleaning head or the upright section, and preferably the surface cleaning head, may include a second or upstream suction motor (e.g. an AC powered suction motor). Accordingly, when the portable cleaning unit is provided on the upright section and the surface cleaning head and/or the upright section is connected to a source of current, the upstream suction motor may be operated, e.g. on AC current, and used to cause air to travel through an airflow path (e.g., push the air in the case of a dirty air motor) to the air treatment member in the portable cleaning unit. An advantage of this design is that the upstream suction motor may provide more air watts than a smaller motor provided in the portable cleaning unit so as to produce a higher airflow and therefore increase cleanability when the portable cleaning unit is provided on the upright section. Alternately, or in addition, the upstream suction motor, when combined with the portable cleaning unit suction motor, may provide more air flow and air watts than the portable cleaning unit suction motor alone and therefore provide increased cleanability. However, when the portable cleaning unit is removed from the upright section, a smaller and lighter suction motor is utilized. While the velocity of the airflow through the portable cleaning unit when removed from the upright section may be decreased, the reduced weight of the suction motor may be beneficial. In addition, a smaller airflow path may be provided when the portable cleaning unit is removed from the upright section, and, accordingly, a smaller AC or DC power suction motor may provide substantially similar airflow in the hand carriable mode.

The portable cleaning unit may comprise at least one air treatment member and a suction motor. The air treatment member may be a cyclonic separation stage, a swirl chamber, a filter bag or any other means known in the vacuum cleaner arts. Accordingly, the portable cleaning unit is useable, e.g., as a vacuum cleaner or the like, when removed from the base. The cyclonic separation stage comprises a cyclone chamber and a material collection chamber. The portable cleaning unit is configured such that the material collection chamber is removable for emptying when the portable cleaning unit is mounted on the base. For example, the material collection chamber may be removed by itself when the portable cleaning unit is mounted on the base. Alternately, the material collection chamber and the cyclone chamber may be removable as a unit (e.g. a cyclone bin assembly). It will be appreciated that the material collection chamber, either by itself or in conjunction with the cyclone chamber and possibly other elements, may be removable from the portable cleaning unit when the portable cleaning unit has been removed from the base. An advantage of this design is that the usability of the surface cleaning apparatus is increased. In particular, when it is needed to empty the dirt collection chamber, all that is needed is to remove the dirt collection chamber either by itself, or, for example, together with the cyclone chamber for emptying. Accordingly, a user did not carry the weight of the motor when the user is emptying the dirt collection chamber.

Preferably, in accordance with this embodiment, the dirt collection chamber and, optionally, the cyclone chamber may be provided on an upper portion of the portable cleaning unit so as to be removable upwardly therefrom.

It will be appreciated by a skilled person in the art that any of the features of the configuration of a portable cleaning unit to permit a dirt collection chamber to be removed from the portable cleaning unit when the portable cleaning unit is mounted on the base as discussed herein may not be utilized with dual motor design disclosed herein, but may be used by itself or in combination with any other feature disclosed herein.

In accordance with another embodiment, the portable cleaning unit may be provided with a pod hose which is removable with the portable cleaning unit from the base. The pod hose may have a smaller diameter and, accordingly, may be used only when the portable cleaning unit has been removed from the base. Accordingly, when the portable cleaning unit is on a base, the pod hose does not form part of the fluid flow path. Accordingly, the smaller diameter of the pod hose does not restrict the airflow path when the portable cleaning unit is placed on a base. An advantage of this design is that the portable cleaning unit may carry a longer hose without increasing the volume taken by the pod hose. In addition, the pod hose, being a smaller diameter, may be more flexible and enhance the usability of the portable cleaning unit in a hand carriable mode. For example, the pod hose may have a greater stretch ratio, for example, of 4:1 to 7:1 or more.

In accordance with this embodiment, a valve may be provided on the portable cleaning unit whereby the pod hose is not in airflow communication with the suction motor when the portable cleaning unit is mounted on the base. However, when the portable cleaning unit is removed from the base, the valve may be actuated (e.g. automatically upon removal of the portable cleaning unit from the base, manually by the user or automatically when the hose is deployed for use) such that pod hose form part of the air flow path.

It will be appreciated by a person skilled in the art that any of the features of the pod hose which are discussed herein may not be utilized with the dual motor design disclosed herein, but may be used by itself or in combination with any other feature disclosed herein.

In accordance with another embodiment, the portable cleaning unit may be operable by AC power supplied to the base when the portable cleaning unit is mounted on the base and may be operable on DC power when the portable cleaning unit is removed from the base. Accordingly, the portable cleaning unit may include an energy storage member (e.g. one or more batteries) which may power the suction motor when the portable cleaning unit is removed from the base. Accordingly, the suction motor may be operable on DC current. When the pod is mounted on the base, and the base is connected to a source of current by an electrical cord, then the suction motor may be in electrical communication with the base so as to be powered by AC current supplied through the electrical cord. For example, the suction motor could have dual winding so as to be operable on both AC and DC current. Alternately, the base may include a power supply to convert the AC current to DC current which is then supplied to the suction motor when the portable cleaning unit is placed on the base. For example, the power supply may comprise an inverter.

In this particular embodiment, it will be appreciated that the batteries in the portable cleaning unit may be charged while the portable cleaning unit is mounted on the base and the base is plugged into an electrical outlet.

In a further alternate embodiment, instead of utilizing electricity from an electrical outlet, the base may include a fuel cell or an alcohol powered internal or external combustion engine. In such an embodiment, the base may produce AC current or DC current, which is then supplied to the suction motor when the portable cleaning unit is mounted on the base and actuated.

It will be appreciated by a person skilled in the art that any of the features of a portable cleaning unit which is operable on AC and DC current as disclosed herein may not be utilized with the dual motor design disclosed herein, but may be used by itself or in combination with any other feature disclosed herein.

In accordance with the further embodiment, the portable cleaning unit may comprise both an energy storage member and a power supply. Accordingly, when the portable cleaning unit is connected to a power source (e.g. a cord extends from the portable cleaning unit to an electrical outlet), AC power may be supplied to the power supply (e.g. an inverter) to convert the AC current to DC which is then utilized to power the suction motor. When a user is unable to or does not want to plug the portable cleaning unit into a wall outlet, the portable cleaning unit may be powered by the energy storage member (e.g. batteries), which provide DC current to a suction motor. Accordingly, the portable cleaning unit may be powered by both AC current from a wall outlet and DC current supplied by batteries as may be desired. In a further alternate embodiment, the suction motor may be provided with two windings. In such a case, the power supply is not required and the suction motor may be powered by both DC current from the batteries and AC current from a wall outlet.

It will be appreciated by a person skilled in the art that any of the features of a pod operable with both AC and DC current as discussed herein may not be utilized with dual motor design disclosed herein, but may be used by itself or in combination with any other feature disclosed herein.

In one embodiment, there is provided a surface cleaning apparatus comprising:

(a) a surface cleaning head having a first dirty fluid inlet;
(b) an upright section moveably mounted to the surface cleaning head between an storage position and a reclined in use position;
(c) a portable cleaning unit removably mounted to the upright section and comprising at least one cyclonic separation stage, a first energy storage member and a portable cleaning unit suction motor;
(d) a fluid flow path extending from the first dirty fluid inlet to the portable cleaning unit; and,
(e) an upstream suction motor provided on one of the surface cleaning head and the upright section, wherein the upstream suction motor is operable to provide motive power to move fluid through the fluid flow path to the portable cleaning unit when the surface cleaning apparatus is switched on and when the portable cleaning unit is mounted to the upright section, and wherein the portable cleaning unit suction motor is operable to provide motive power to move fluid through the portable cleaning unit when the portable cleaning unit is switched on and when the portable cleaning unit is removed from the upright section.

In some embodiments, one of the surface cleaning head and the upright section may further comprise or be connectable to a power cord and the portable cleaning unit may be powered solely by the first energy storage member when the portable cleaning unit is removed from the upright section.

In some embodiments, one of the surface cleaning head and the upright section may further comprise or be connectable to a power cord, the first energy storage member may comprises one or more batteries and the one or more batteries may be charged when the portable cleaning unit is mounted on the upright section.

In some embodiments, the portable cleaning unit suction motor may not be used to provide motive power to move fluid through the fluid flow path when the surface cleaning apparatus is switched on and when the portable cleaning unit is mounted on the upright section.

In some embodiments, the upstream suction motor may be in the fluid flow path and is a dirty air motor.

In some embodiments, the surface cleaning apparatus may further comprise a downstream fluid flow path extending from an inlet of the portable cleaning unit to a clean air outlet and the portable cleaning unit suction motor may be in the downstream fluid flow path.

In some embodiments, the portable cleaning unit may further comprise or be connectable to a power cord.

In some embodiments, the power cord may provide power to the portable cleaning unit suction motor and provide power to the upstream suction motor.

In some embodiments, one of the surface cleaning head and the upright section may further comprise a second energy storage member.

In some embodiments, the second energy storage member may charge the first energy storage member when the portable cleaning unit is mounted on the upright section.

In some embodiments, the portable cleaning unit suction motor may be operable on DC power and the upstream suction motor may be operable on AC power.

In some embodiments, the upright section may be an up flow duct.

In another embodiment, there is provided a surface cleaning apparatus comprising:

(a) a surface cleaning head having a first dirty fluid inlet;

(b) an upright section moveably mounted to the surface cleaning head between an storage position and a reclined in use position;

(c) a portable cleaning unit removably mounted to the upright section and comprising at least one cyclonic separation stage, a first energy storage member and a portable cleaning unit suction motor; and, (d) a fluid flow path extending from the first dirty fluid inlet to the portable cleaning unit, wherein at least one of the surface cleaning head, the upright section and the portable cleaning unit is connectable to an external source of power, the portable cleaning unit suction motor is operable on power provided by the first energy storage member when removed from the upright section and is operable on power provided by the external source of power when mounted to the upright section.

In some embodiments, the portable cleaning unit suction motor may be operable on DC power.

In some embodiments, one of the surface cleaning head and the upright section may further comprise or be connectable to a power cord and the portable cleaning unit may be powered solely by the first energy storage member when the portable cleaning unit is removed from the upright section.

In some embodiments, one of the surface cleaning head and the upright section may further comprise or be connectable to a power cord, the first energy storage member may comprises one or more batteries and the one or more batteries may be charged when the portable cleaning unit is mounted on the upright section.

In some embodiments, the upright section may be an up flow duct.

In some embodiments, the portable cleaning unit suction motor may be operable on DC power and the upstream suction motor may be operable on AC power.

In some embodiments, the portable cleaning unit suction motor may be a dirty air motor and the upstream suction motor may be a clean air motor.

In some embodiments, the portable cleaning unit may further comprise or be connectable to a power cord and the portable cleaning unit suction motor may also be operable on power provided by the external source of power when removed from to the upright section.

In another embodiment, there is provided a surface cleaning apparatus comprising (a) a wheeled base comprising an AC suction motor;

(b) a portable cleaning unit removably mounted on the wheeled base and comprising at least one cyclonic separation stage, a first energy storage member and a portable cleaning unit suction motor that is operable on DC power; and, (c) a fluid flow path extending from a first dirty fluid inlet to a clean air outlet of the surface cleaning apparatus, wherein the AC suction motor provides motive power to move fluid through the fluid flow path when the surface cleaning unit is switched on and when the portable cleaning unit is mounted on the wheeled base, and wherein the portable cleaning unit suction motor provides motive power to move fluid through the fluid flow path when the portable cleaning unit is switched on and when the portable cleaning unit is removed from the wheeled base In some embodiments, the wheeled base may further comprise or is connectable to a power cord and the portable cleaning unit is powered solely by the first energy storage member when the portable cleaning unit is removed from the wheeled base.

In some embodiments, the wheeled base may further comprise or is connectable to a power cord, the first energy storage member comprises batteries and the batteries are charged when the portable cleaning unit is mounted on the wheeled base.

In some embodiments, the suction motor in the portable cleaning unit may not be used to provide motive power to move fluid through the fluid flow path when the surface cleaning unit is switched on and when the portable cleaning unit is mounted on the wheeled base.

In some embodiments, the fluid flow path may comprise an upstream portion that extends from the first dirty fluid inlet to the portable cleaning unit and the AC suction motor is in the fluid flow path.

In some embodiments, the fluid flow path may comprise a downstream fluid flow path extending through the portable cleaning unit to the clean air outlet and the portable cleaning unit suction motor is in the downstream fluid flow path.

In some embodiments, the portable cleaning unit may comprise a flexible hose having a second dirty fluid inlet and the flexible hose is part of the downstream fluid flow path when the portable cleaning unit is removed from the wheeled base.

In some embodiments, the flexible hose may be an electrified flexible hose.

In some embodiments, the wheeled base may further comprise a second energy storage member.

In some embodiments, the second energy storage member may charge the first energy storage member when the portable cleaning unit is mounted on the wheeled base.

In some embodiments, the portable cleaning unit suction motor may be a DC motor.

In one embodiment, there is provided a surface cleaning apparatus comprising (a) a wheeled based connectable to a source of current;

(b) a portable cleaning unit removably mounted on the wheeled base and comprising at least one cyclonic separation stage, a first energy storage member and a portable cleaning unit suction motor that is operable on DC power; and, (c) a fluid flow path extending from a first dirty fluid inlet to a clean air outlet of the surface cleaning apparatus, wherein the portable cleaning unit suction motor is operable on DC power when removed from the wheeled base and is operable on power provided by the wheeled base when mounted on the wheeled base.

In some embodiments, the portable cleaning unit suction motor may be a DC motor.

In some embodiments, the wheeled base may further comprise or is connectable to a power cord and the portable cleaning unit is powered solely by the first energy storage member when the portable cleaning unit is removed from the wheeled base.

In some embodiments, the wheeled base may further comprise or is connectable to a power cord, the first energy storage member comprises batteries and the batteries are charged when the portable cleaning unit is mounted on the wheeled base.

In some embodiments, the wheeled base may further comprise or is connectable to a power cord, the wheeled base further comprises a circuit that receives AC current and outputs DC current and the portable cleaning unit is powered the DC current when the portable cleaning unit is mounted on the wheeled base.

In some embodiments the portable cleaning unit suction motor may operate at a first power level when removed from the wheeled base and at a second power level when is mounted on the wheeled base.

In some embodiments the first power level may be less than the second power.

In accordance with another aspect, a surface cleaning apparatus, preferably a canister or Shop-Vac™ style vacuum cleaner is provided which comprises a portable cleaning unit and a wheeled base. Preferably, the cleaning unit is removably mounted to the wheeled base. Alternately, or in addition, the wheeled base has wheels mounted outward of the wheeled base, and which are preferably of a larger diameter (e.g., 1-3 inches in diameter, preferably 1.5-2.5 inches in diameter).

According to this aspect, the surface cleaning apparatus may comprise a member having a dirty fluid inlet. A fluid flow path extends from the dirty fluid inlet to a clean air outlet of the surface cleaning apparatus. The surface cleaning apparatus further comprises a wheeled based. A portable cleaning unit is removably mounted on the wheeled base and comprising at least one cyclonic separation stage and a suction motor positioned in the fluid flow path.

Embodiments in accordance with this broad aspect may be advantageous because the surface cleaning apparatus may have increased maneuverability. That is, the surface cleaning apparatus may be used as a wheel mounted surface cleaning apparatus when convenient for a user since the user need not carry the surface cleaning apparatus, or as a hand or strap carriable surface cleaning apparatus, such as when a stairs or a smaller or crowded area is to be cleaned, according to the user's preference.

In some embodiments, the at least one cyclonic separation stage may comprise a cyclone chamber having at least one material outlet, a divider plate associated with the material outlet and an associated material collection chamber in flow communication with the material outlet.

In some embodiments, the material collection chamber may be positioned below the material outlet. In a further embodiment, the divider plate may be positioned in the material outlet.

In some embodiments, the material collection chamber may be moveable relative to the cyclone chamber. In a further embodiment the material collection chamber may be removable from the at least one cyclone chamber.

In some embodiments, the material collection chamber may have a portion that is openable. In a further embodiment, the portion that is openable may be a bottom wall. Such embodiments may be advantageous because the wheeled base may prevent accidental opening of the material collection chamber.

In some embodiments, the suction motor may be positioned laterally spaced from the at least one cyclonic separation stage. Accordingly, the surface cleaning apparatus may have a relatively wide stance and low center of mass, and therefore may have increased stability.

In some embodiments, the cleaning unit has a front end having the dirty fluid inlet and the front end of the cleaning unit is positioned at a front end of the wheeled base and the suction motor is positioned rearward of the at least one cyclonic separation stage.

In some embodiments, the wheeled base may have a length greater than its width. In further embodiments, the wheeled base may be generally polygonal, and preferably generally triangular in shape. Such embodiments may be advantageous because the surface cleaning apparatus may have both increased maneuverability and increased stability.

In some embodiments, the wheeled base may have at least one front wheel and at least two rear wheels, the rear wheels may have a larger diameter then the at least one front wheel and the at least one front wheel may be steerable. Such embodiments may be advantageous because the larger rear wheels may provide the wheeled base with increased stability, and the steerable front wheel may provide the wheeled base with increased maneuverability. Alternately, the front wheels may have a larger diameter or essentially the same diameter as the rear wheels.

In some embodiments, the wheeled base may have at least one front wheel and at least two rear wheels and the rear wheels may have a larger diameter then the at least one front wheel.

In some embodiments, the wheeled base may have at least one front wheel and at least two rear wheels and the rear wheels may have a smaller diameter then the at least one front wheel.

In some embodiments, the at least one front wheel may be steerable.

In some embodiments, the wheeled base may have rear wheels that are positioned outwardly of an area occupied by the cleaning unit when the cleaning unit is mounted on the wheeled base. Alternately, or in addition, the wheeled base may have front wheels that are positioned outwardly of an area occupied by the cleaning unit when the cleaning unit is mounted on the wheeled base. Such embodiments may be advantageous because the wheeled base may have a relatively wide stance, thereby providing greater stability to the surface cleaning apparatus. Additionally, the surface cleaning apparatus may be relatively close to the ground, and may therefore have a lower center of mass and increased stability.

In some embodiments, the cleaning unit may have a front end having a fluid inlet downstream from the dirty fluid inlet and the front end of the cleaning unit is positioned at a front end of the wheeled base.

In some embodiments, the cleaning unit may be lockably receivable on the wheeled base.

In some embodiments, the wheeled base may have at least one front wheel having a diameter of 1 to 3 inches and at least two rear wheels having a diameter of 1 to 3 inches.

In some embodiments, the cleaning unit may have a carry handle and/or a shoulder strap.

In some embodiments, the wheeled base may have at least one front wheel and at least two rear wheels, and the cleaning unit is receivable on an open platform.

In some embodiments, the wheeled base may have an absence of operating components.

In accordance with another aspect, a surface cleaning apparatus is operable using an on board storage member in a first mode of operation and may operable using an external power source (e.g., AC power from a wall outlet) in another mode of operation. The first mode may be used when a portable cleaning unit, such as a hand vacuum cleaner, is removed from the remainder of the surface cleaning apparatus.

In accordance with this aspect, there is provided a surface cleaning apparatus comprising:

(a) a surface cleaning head having a first dirty fluid inlet;

(b) an upright section moveably mounted to the surface cleaning head between a storage position and a reclined in use position;

(c) a portable cleaning unit removably mounted to the upright section and comprising at least one air treatment member, a first energy storage member and a portable cleaning unit suction motor;

a fluid flow path extending from the first dirty fluid inlet to the portable cleaning unit; and, (d) an upstream suction motor provided on one of the surface cleaning head and the upright section, wherein the upstream suction motor is operable to provide motive power to move fluid through the fluid flow path to the portable cleaning unit when the surface cleaning apparatus is switched on and when the portable cleaning unit is mounted to the upright section, and wherein the portable cleaning unit suction motor is operable to provide motive power to move fluid through the portable cleaning unit when the portable cleaning unit is switched on and when the portable cleaning unit is removed from the upright section.

In some embodiments, one of the surface cleaning head and the upright section may further comprise or may be connectable to a power cord and the portable cleaning unit may be powered solely by the first energy storage member when the portable cleaning unit is removed from the upright section.

In some embodiments, one of the surface cleaning head and the upright section may further comprise or may be connectable to a power cord, the first energy storage member may comprise one or more batteries and the one or more batteries may be charged when the portable cleaning unit is mounted on the upright section.

In some embodiments, the portable cleaning unit suction motor may not be used to provide motive power to move fluid through the fluid flow path when the surface cleaning apparatus is switched on and when the portable cleaning unit is mounted on the upright section.

In some embodiments, the upstream suction motor may be in the fluid flow path and may be a dirty air motor.

In some embodiments, the surface cleaning apparatus may further comprise a downstream fluid flow path extending from an inlet of the portable cleaning unit to a clean air outlet and the portable cleaning unit suction motor may be in the downstream fluid flow path.

In some embodiments, the portable cleaning unit may further comprise or may be connectable to a power cord.

In some embodiments, the power cord may provide power to the portable cleaning unit suction motor and may provide power to the upstream suction motor.

In some embodiments, one of the surface cleaning head and the upright section may further comprise a second energy storage member.

In some embodiments, the second energy storage member may charge the first energy storage member when the portable cleaning unit is mounted on the upright section.

In some embodiments, the portable cleaning unit suction motor may be operable on DC power and the upstream suction motor may be operable on AC power.

In some embodiments, the upright section may comprise an up flow duct and the portable cleaning unit may be a hand vacuum cleaner.

In accordance with this aspect, there is also provided a surface cleaning apparatus comprising:

(a) a surface cleaning head having a first dirty fluid inlet;

(b) an upright section moveably mounted to the surface cleaning head between an storage position and a reclined in use position;

(c) a portable cleaning unit removably mounted to the upright section and comprising at least one air treatment member, a first energy storage member and a portable cleaning unit suction motor; and, (d) a fluid flow path extending from the first dirty fluid inlet to the portable cleaning unit, wherein at least one of the surface cleaning head, the upright section and the portable cleaning unit is connectable to an external source of power, the portable cleaning unit suction motor is operable on power provided by the first energy storage member when removed from the upright section and is operable on power provided by the external source of power when mounted to the upright section.

In some embodiments, the portable cleaning unit suction motor may be operable on DC power.

In some embodiments, one of the surface cleaning head and the upright section may further comprise or may be connectable to a power cord and the portable cleaning unit may be powered solely by the first energy storage member when the portable cleaning unit is removed from the upright section.

In some embodiments, one of the surface cleaning head and the upright section may further comprise or may be connectable to a power cord, the first energy storage member comprises one or more battery and the one or more battery may be charged when the portable cleaning unit is mounted on the upright section.

In some embodiments, the upright section may comprise an up flow duct and the portable cleaning unit is a hand vacuum cleaner.

In some embodiments, the portable cleaning unit suction motor may be operable on DC power and the upstream suction motor may be operable on AC power.

In some embodiments, the portable cleaning unit suction motor may be a dirty air motor and the upstream suction motor may be a clean air motor.

In some embodiments, the portable cleaning unit may further comprise or may be connectable to a power cord and the portable cleaning unit suction motor may be also operable on power provided by the external source of power when removed from to the upright section.

It will be appreciated by a person skilled in the art that a surface cleaning apparatus may embody any one or more of the features contained herein and that the features may be used in any particular combination or sub-combination.

DRAWINGS

The drawings included herewith are for illustrating various examples of articles, methods, and apparatuses of the teaching of the present specification and are not intended to limit the scope of what is taught in any way.

DESCRIPTION OF VARIOUS EMBODIMENTS

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 1:
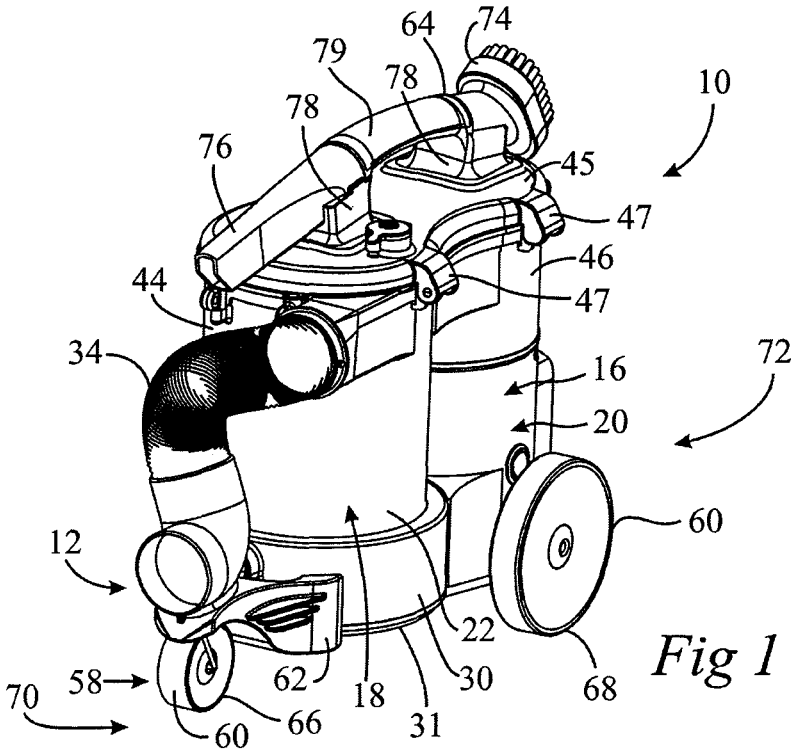
FIG. 1 is a perspective view of an embodiment of a surface cleaning apparatus of the present invention.
Figure 2:
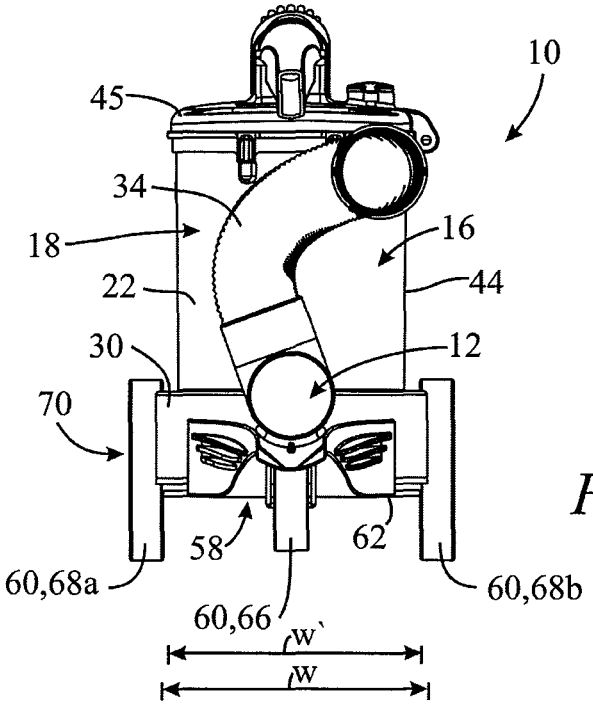
FIG. 2 is a front view of the embodiment of FIG. 1.
Figure 3:
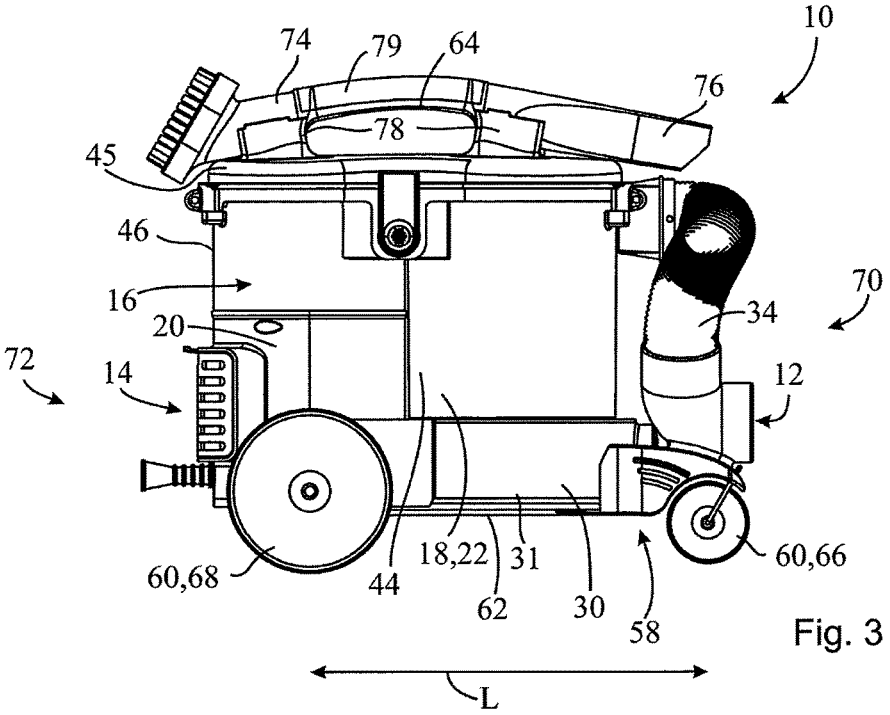
FIG. 3 is a side view of the embodiment of FIG. 1.
Figure 4:
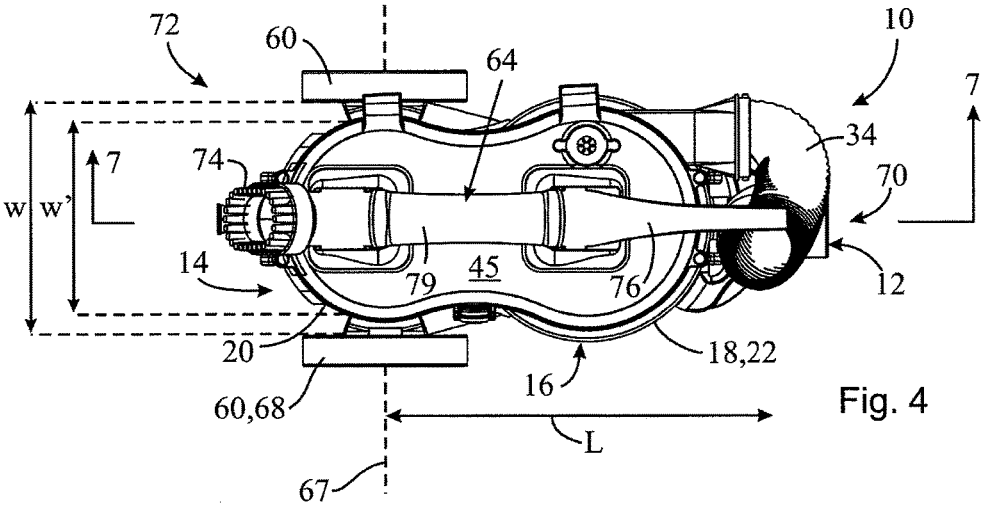
FIG. 4 is a top view of the embodiment of FIG. 1.
Figure 12:
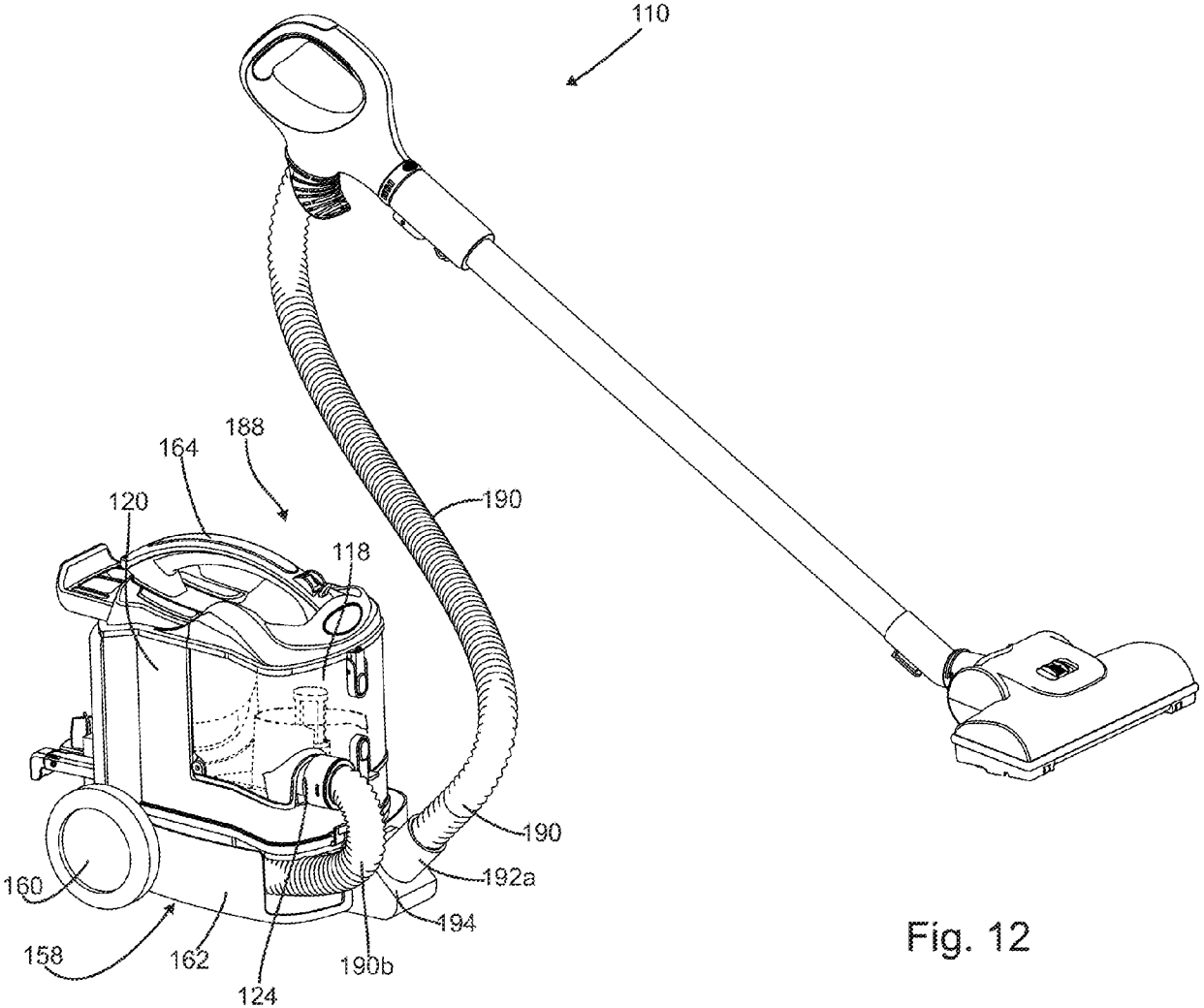
FIG. 12 is another perspective view of the surface cleaning apparatus of FIG. 11.
Figure 18:
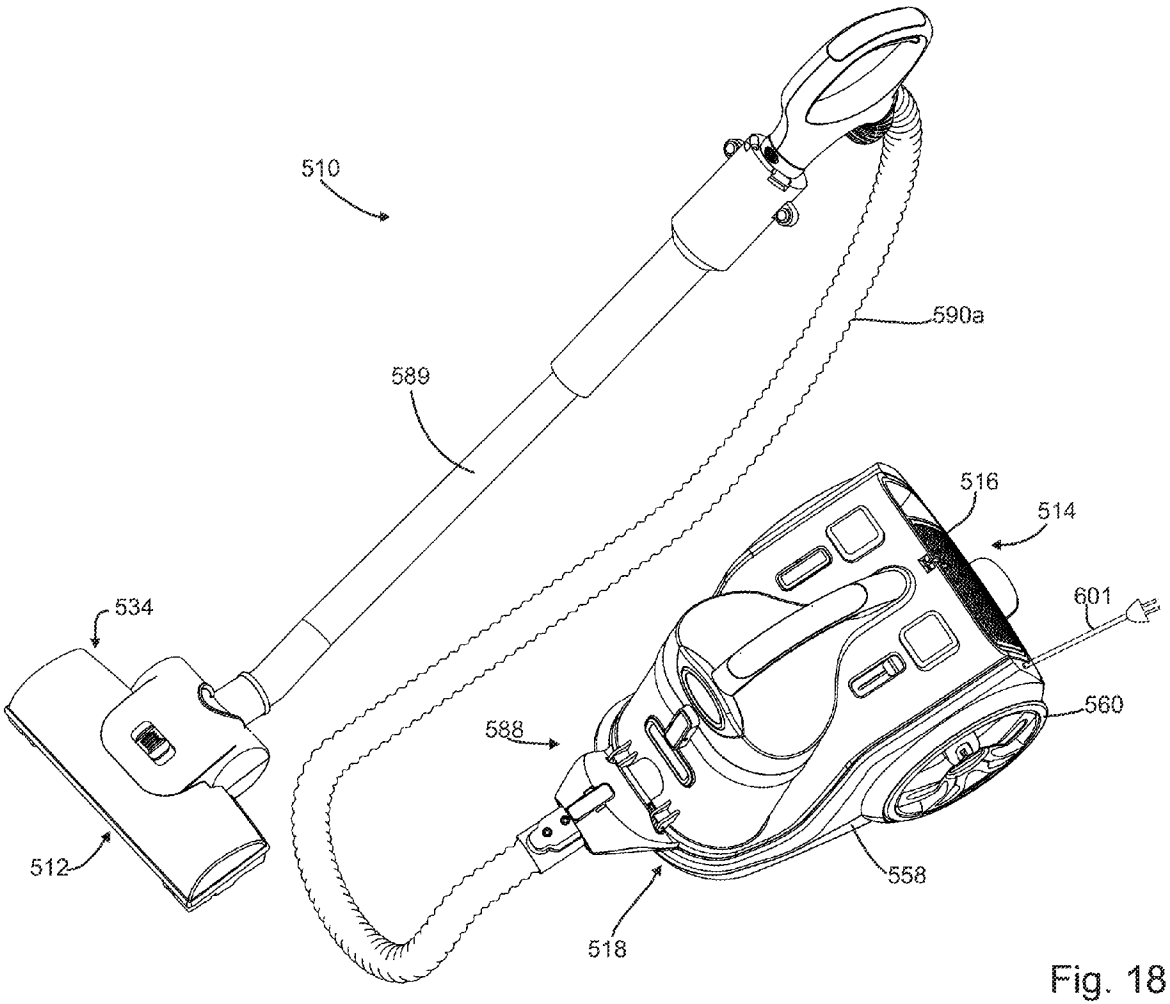
FIG. 18 is a perspective view of another embodiment of a surface cleaning apparatus.
Figure 22:
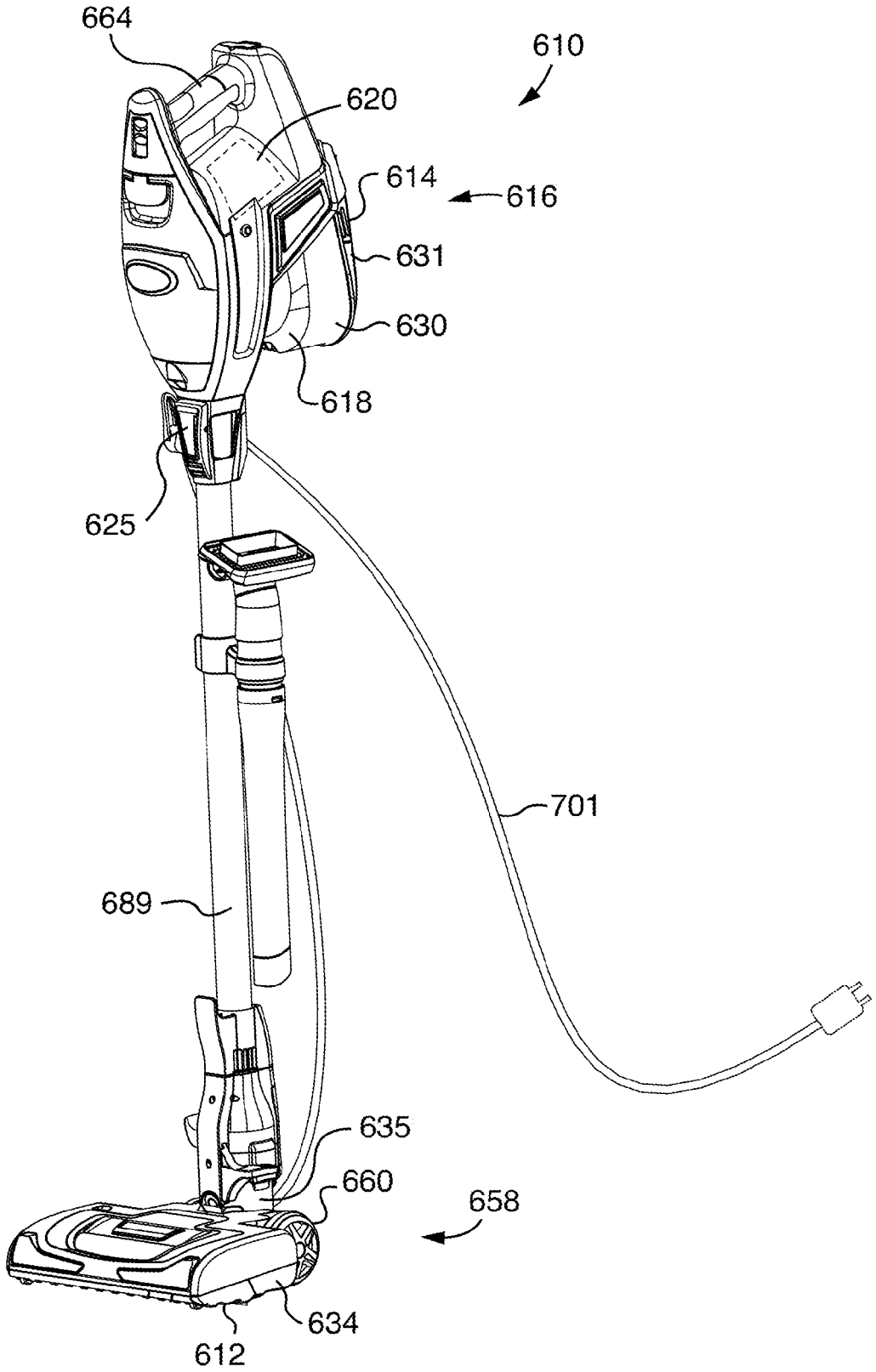
FIG. 22 is a perspective view of a surface cleaning apparatus in accordance with another embodiment.

It will be appreciated that technologies discussed with respect to an embodiment using a wheeled base as exemplified in FIG. 1, 12 or 18 may be used individually or jointly in the embodiment utilizing a surface cleaning head with an upright section moveably mounted thereto as exemplified in FIG. 22 wherein a handheld vacuum cleaner is provided on the downstream end of a up flow conduit 689, which may be removed from the surface cleaning head and used as an above floor cleaning wand.

Portable Cleaning Unit Construction

The following is a description of portable cleaning unit constructions that may be used by itself in any surface cleaning apparatus or in any combination or sub-combination with any other feature or features disclosed herein.

Referring to FIGS. 1-4, an embodiment of a surface cleaning apparatus 10 of the present invention is shown. Surface cleaning apparatus 10 may be a canister type vacuum cleaner, a Shop-Vac™ type vacuum cleaner, or another type of vacuum cleaner that may be mounted to a wheeled base. Surface cleaning apparatus 10 comprises a dirty fluid inlet 12, a clean air outlet 14, and a fluid flow path extending therebetween. A portable cleaning unit 16 is provided in the fluid flow path. Cleaning unit 16 comprises at least one cyclonic separation stage 18 for removing dirt from air, or for removing liquid from air or to pick up liquid.

Cleaning unit 16 further comprises a suction motor 20 for drawing fluid from the dirty fluid inlet 12 to the clean air outlet 14.

Dirty fluid inlet 12 is provided in a member 34. In the embodiment shown in FIGS. 1-6, member 34 is a hose. In the embodiment shown in FIGS. 7-10, member 34 is a nozzle. In other embodiment, member 34 may be, for example, a surface cleaning head. It will be appreciated that a flexible hose, a rigid wand or other attachment may be affixed or removably affixed to portable cleaning unit 16.

Figure 7:
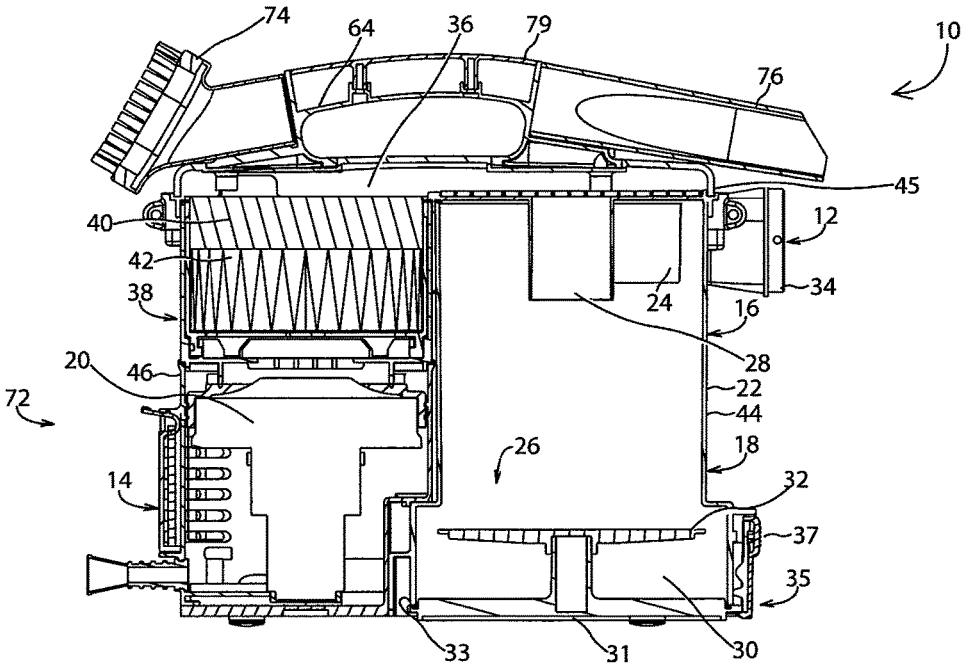
FIGS. 7-9 are cross-sections taken along line 7-7 in FIG. 1, showing alternate configurations of a cleaning unit.
Figure 8:
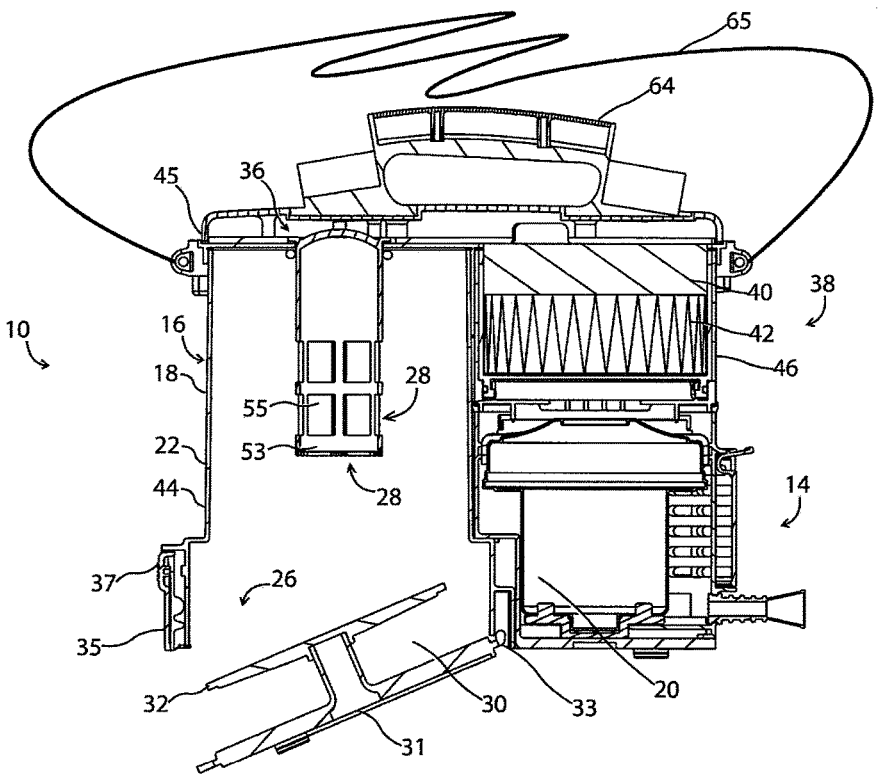
Figure 9:
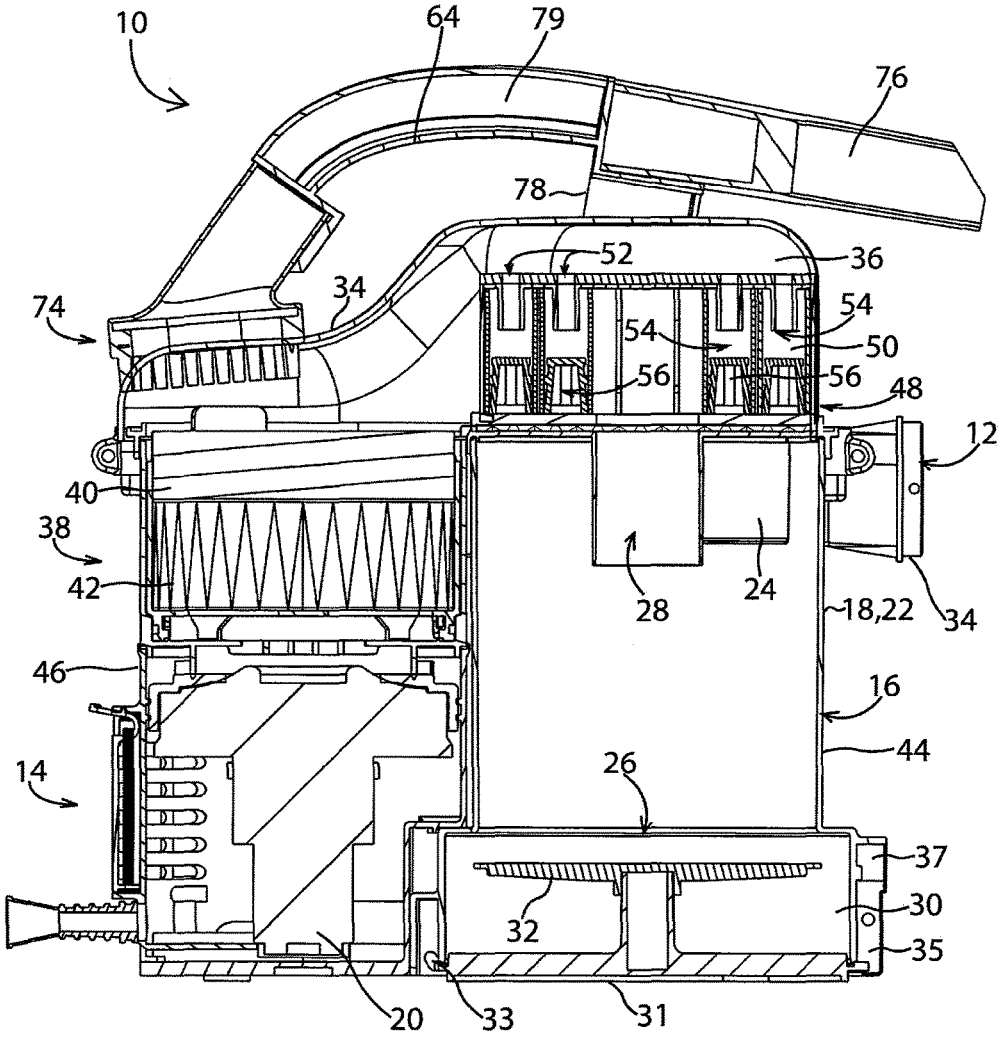

Referring to the exemplified embodiments of FIGS. 7-9, from dirty fluid inlet 12, fluid is directed to cleaning unit 16. Cleaning unit 16 may be of a variety of configurations. In the embodiment of FIGS. 7 and 8, cleaning unit 16 comprises a single cyclonic cleaning stage 18 preferably comprising a single cyclone housed in a first housing 44, and a filter assembly 38 and motor 20 housed in a second housing 46 adjacent the first housing. Accordingly, in this embodiment, the suction motor 20 is positioned laterally adjacent and laterally spaced from the cyclonic cleaning stage 18. In the embodiment of FIG. 9, cleaning unit 16 comprises first 18 and second 48 cleaning stages housed in first housing 44, and filter assembly 38 and motor 20 housed in second housing 46 laterally adjacent the first housing. In this embodiment, motor 20 is positioned laterally spaced from and laterally adjacent both of first 18 and second 48 cleaning stages. It will be appreciated that portable cleaning unit may utilize one or more cyclonic cleaning stages, each of which may comprise a single cyclone or a plurality of cyclones in parallel. In any embodiment, one or more additional cleaning stages may be used such as one or more filters.

For example, in the embodiments exemplified, cyclonic cleaning stage 18 includes a single cyclone chamber 22. Cyclone chamber 22 comprises a dirty air inlet 24, a separated or dirty material outlet 26, and a clean air outlet 28. A dirty or separated material collection chamber 30 is mounted below dirty material outlet 26, for collecting material removed from the air in cyclone chamber 22. In the embodiment shown, a divider plate 32 is associated with dirty material outlet 26. Divider plate 32 is positioned below the dirty material outlet 26, within the material collection chamber 30. It will be appreciated that a divider plate may be used any one or more of the cyclones and it may be of any configuration and located at any position known in the art. Alternately, a divider plate may not be used and the cyclone chambers may be of any design.

Material collection chamber 30 may be of any configuration and may be emptied by a user in any manner known in the art. In the embodiment shown in FIGS. 7 and 8, material collection chamber 30 has a bottom 31 that is openable by pivoting about a pivot pin 33. In this embodiment, material collection chamber further comprises a latch 35, for locking bottom 31 in place, and a button 37 for releasing the latch. In other embodiments, material collection chamber 30 may be emptied in another manner. For example, material collection chamber 30 may be movable or removable from surface cleaning apparatus 10, such that it may be emptied, or may have another portion that opens. It may be removable from portable cleaning unit with the associated cyclone or cyclones as a sealed unit. See for example the embodiments of FIGS. 14 and 19.

In some embodiments, a filter or a screen may be associated with clean air outlet 28. For example, as shown in FIG. 8, a cylindrical housing 53 may be mounted on clean air outlet 28 and may have a plurality of openings 55 which are provided with a screen (e.g. a wire mesh). Any such screen or filter known in the art may be used.

In the embodiment of FIGS. 7 and 8, air is directed from cyclone chamber 22 out of clean air outlet 28, and into an airflow passage 36, which extends between first housing 44 and second housing 46. From airflow passage 36, air is directed through a filter assembly 38, which, in the embodiments exemplified, comprises a pre-motor foam filter 40, and a screen filter 42. From filter assembly 38, air is drawn past motor 20, and out of clean air outlet 14.

In the exemplified embodiment of FIG. 9, from cyclone chamber 22, air is directed out of clean air outlet 28 and into second cyclonic cleaning stage 48. Second cyclonic cleaning stage 48 comprises a plurality of second stage cyclones 50 in parallel. Each second stage cyclone comprises an inlet (not shown) in fluid communication with clean air outlet 28, and an outlet 52 in fluid communication with airflow passage 36. Each second stage cyclone comprises a cyclonic cleaning region 54, and a dirt collection region 56. From outlets 28, air is directed into airflow passage 36, and into filter assembly 38. From filter assembly 38, air is drawn past motor 20, and out of clean air outlet 14.

In other embodiments, cleaning unit 16 may be otherwise configured. For example, cleaning unit 16 may not comprise a filter assembly, or may comprise a plurality of filter assemblies. Additionally, cleaning unit 16 may comprise additional cleaning stages, which may be positioned laterally adjacent each other or above each other.

Figure 10:
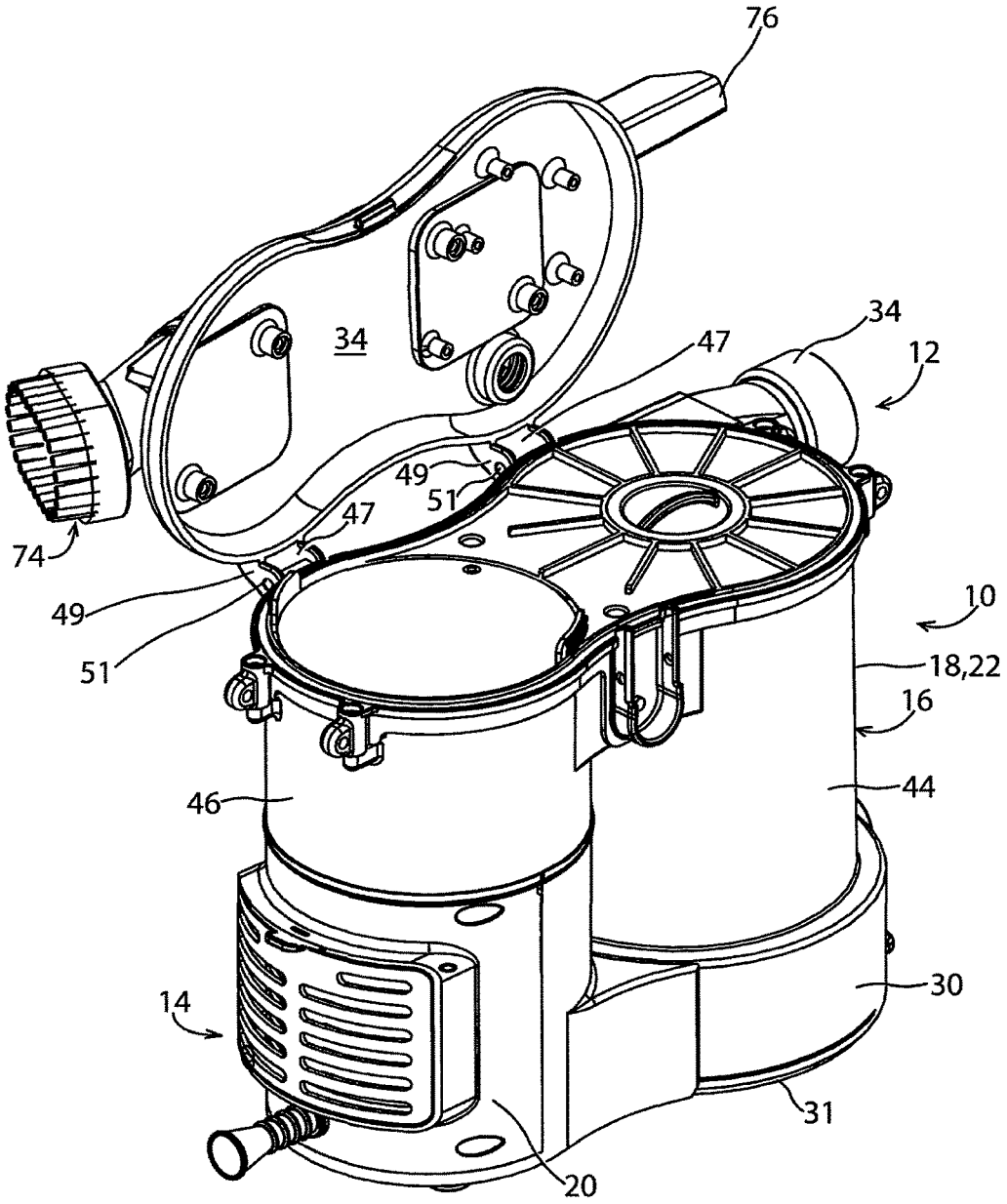
FIG. 10 is a perspective illustration of an alternate embodiment of a surface cleaning apparatus of the present invention, showing a lid in an open position.

In the embodiments shown, the first 44 and second 46 housings are integrally molded. In other embodiments, the first 44 and second 46 housings may be separately manufactured and then secured together, such as by a common base or by gluing, welding or mechanically securing the two housings together. In some embodiments, first 44 and/or second 46 housing may be provided with an openable lid 45, as shown in FIG. 10. When a user opens lid 45, the user may have access to components housed in first 44 and/or second housing 46. For example, as shown in FIG. 10, lid 45 may be provided with a plurality of flanges 47, which are mounted on flanges 49 provided on housings 44 and/or 46. Flanges 47 are pivotally connected together by pivot pins 51. Accordingly, lid 45 may be pivoted from the closed position, as shown in FIGS. 1-9, to the opened position, as shown in FIG. 10.

Figure 11:
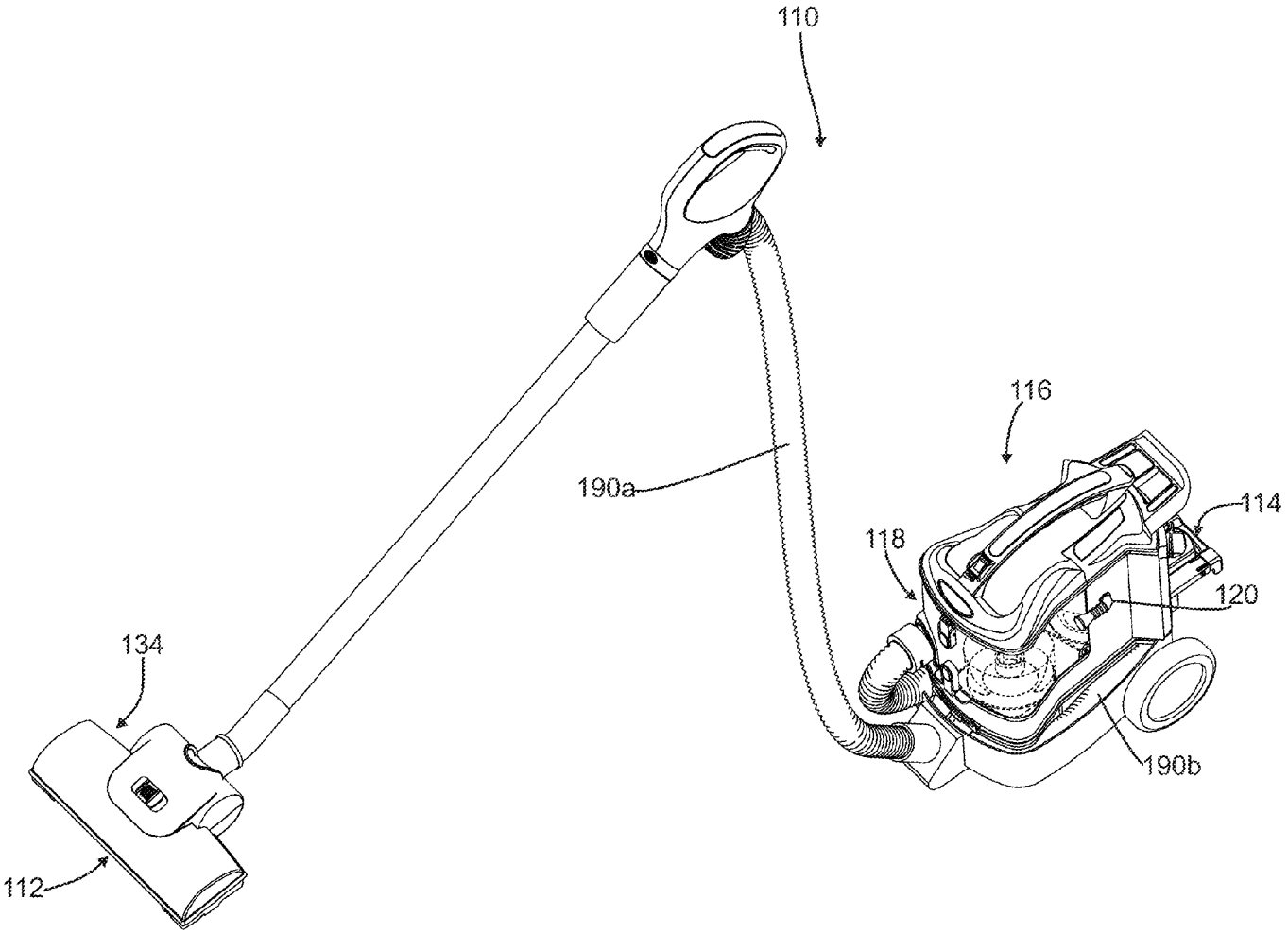
FIG. 11 is a perspective view of another embodiment of a surface cleaning apparatus.

Referring to FIG. 11, another embodiment of a surface cleaning apparatus 110 is shown. Surface cleaning apparatus 110 is generally similar to surface cleaning apparatus 10, and analogous features are identified using like reference characters indexed by 100.

Surface cleaning apparatus 110 comprises a dirty fluid inlet 112, a clean air outlet 114, and a fluid flow path extending therebetween. A portable cleaning unit 116 is provided in the fluid flow path. Cleaning unit 116 comprises at least one cyclonic separation stage 118 for removing dirt from air, or for removing liquid from air or to pick up liquid. Cleaning unit 116 further comprises a suction motor 120 for drawing fluid from the dirty fluid inlet 112 to the clean air outlet 114. Dirty fluid inlet 112 is provided in a member 134, which in this embodiment is a surface cleaning head.

Figure 13:
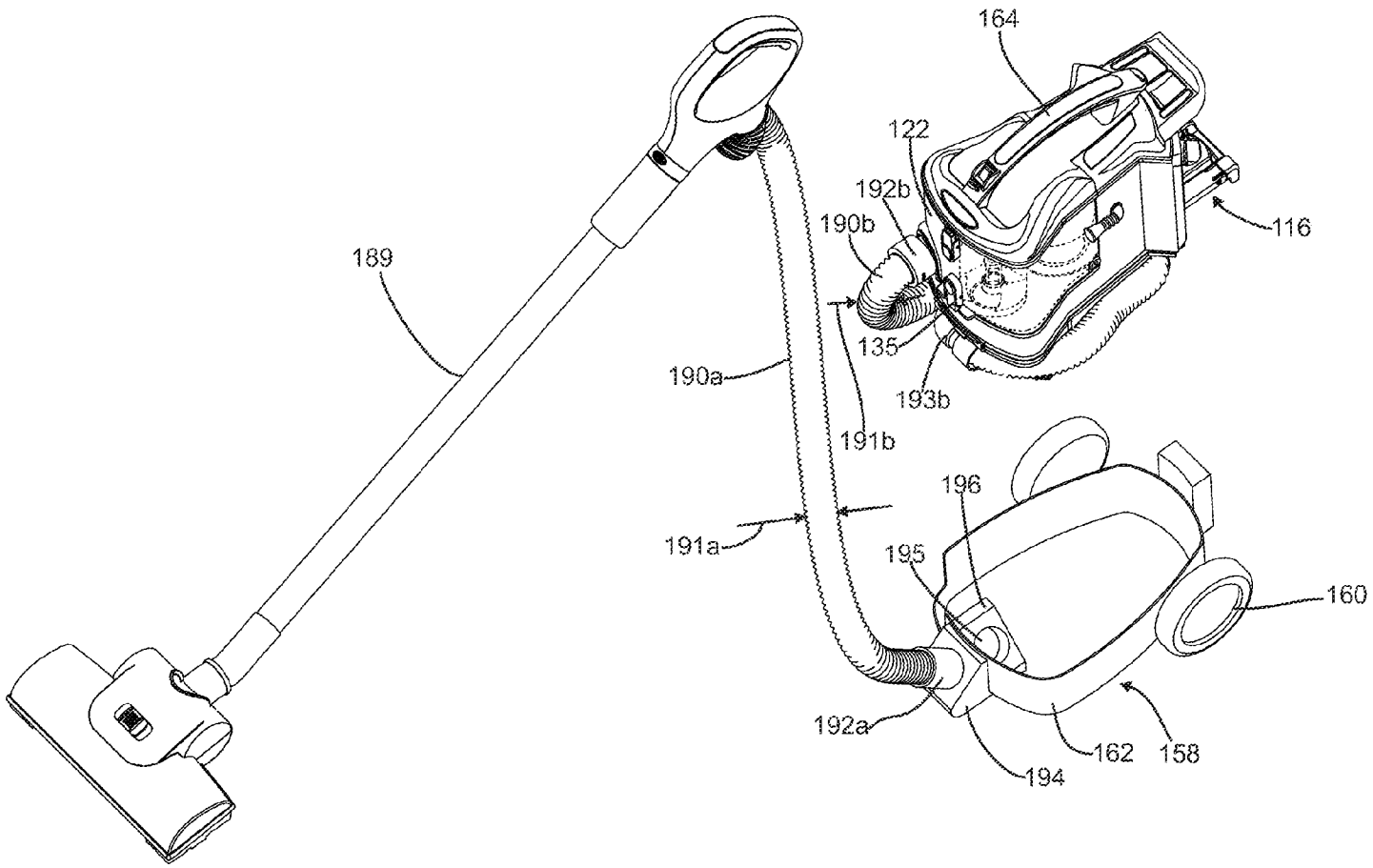
FIG. 13 is a perspective view of the surface cleaning apparatus of FIG. 11 with a surface cleaning unit detached.

In this embodiment the cleaning unit 116 is mounted to a wheeled base 158. Wheeled base 158 comprises a plurality of wheels 160, and a cradle 162, which receives cleaning unit 116. The portable cleaning unit 116 can be operated while seated in the cradle 162 (FIGS. 11 and 12) and can be lifted out of the cradle 162 and used as a hand carriable apparatus (FIG. 13).

Figure 14:
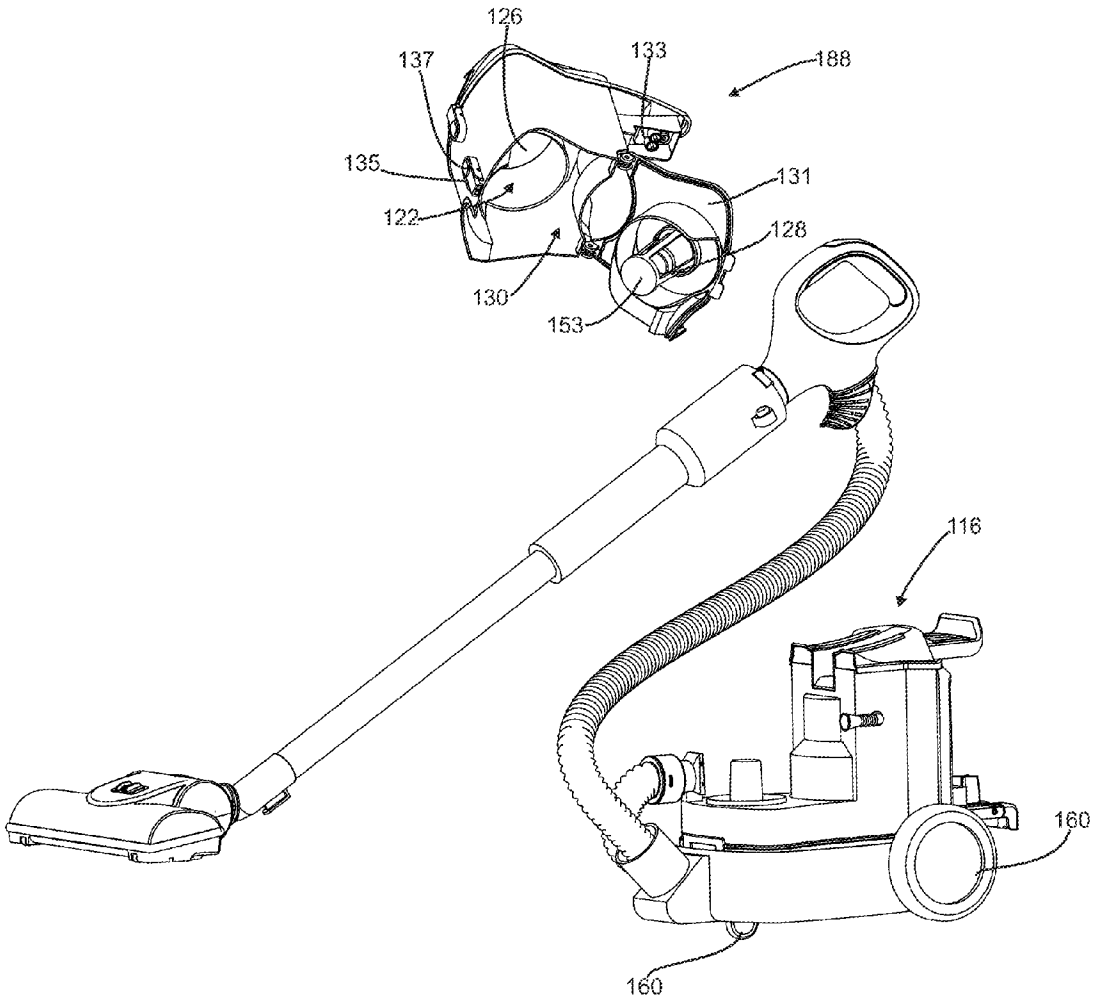
FIG. 14 is another perspective view of the surface cleaning apparatus of FIG. 11 with a surface cleaning unit detached.

Referring to FIG. 14, in this embodiment the cyclone cleaning stage 118 includes a cyclone chamber 122. Cyclone chamber 122 comprises a dirty air inlet 124, a separated or dirty material outlet 126, and a clean air outlet 128 (FIG. 14). A dirty or separated material collection chamber 130 is beside the cyclone chamber 122 and in communication with the dirty material outlet 126, for collecting material removed from the air in cyclone chamber 122.

Material collection chamber 130 may be of any configuration and may be emptied by a user in any manner known in the art. In the embodiment shown in FIG. 14, material collection chamber 130 has a bottom 131 that is openable by pivoting about a pivot pin 133. In this embodiment, material collection chamber further comprises a latch 135, for locking bottom 131 in place, and a button 137 for releasing the latch. In this embodiment the material collection chamber 130 may be movable or removable from surface cleaning apparatus 110 and from the portable cleaning unit 116, such that it may be emptied, and is removable from portable cleaning unit 116 with the associated cyclone 118 or cyclones as a sealed unit.

Referring to FIGS. 18-21, another embodiment of a surface cleaning apparatus 510 is shown. Apparatus 510 is generally similar to surface cleaning apparatus 10, and analogous features are identified using like reference characters indexed by 500.

Referring to FIG. 18, surface cleaning apparatus 510 comprises a dirty fluid inlet 512, a clean air outlet 514, and a fluid flow path extending therebetween. A portable cleaning unit 516 is provided in the fluid flow path. Cleaning unit 516 comprises at least one cyclonic separation stage 518 (FIG. 21) for removing dirt from air, or for removing liquid from air or to pick up liquid. Cleaning unit 516 further comprises a suction motor 520 (FIG. 20) for drawing fluid from the dirty fluid inlet 512 to the clean air outlet 514. Dirty fluid inlet 512 is provided in a member 534, which in this embodiment is a surface cleaning head.

Figure 20:
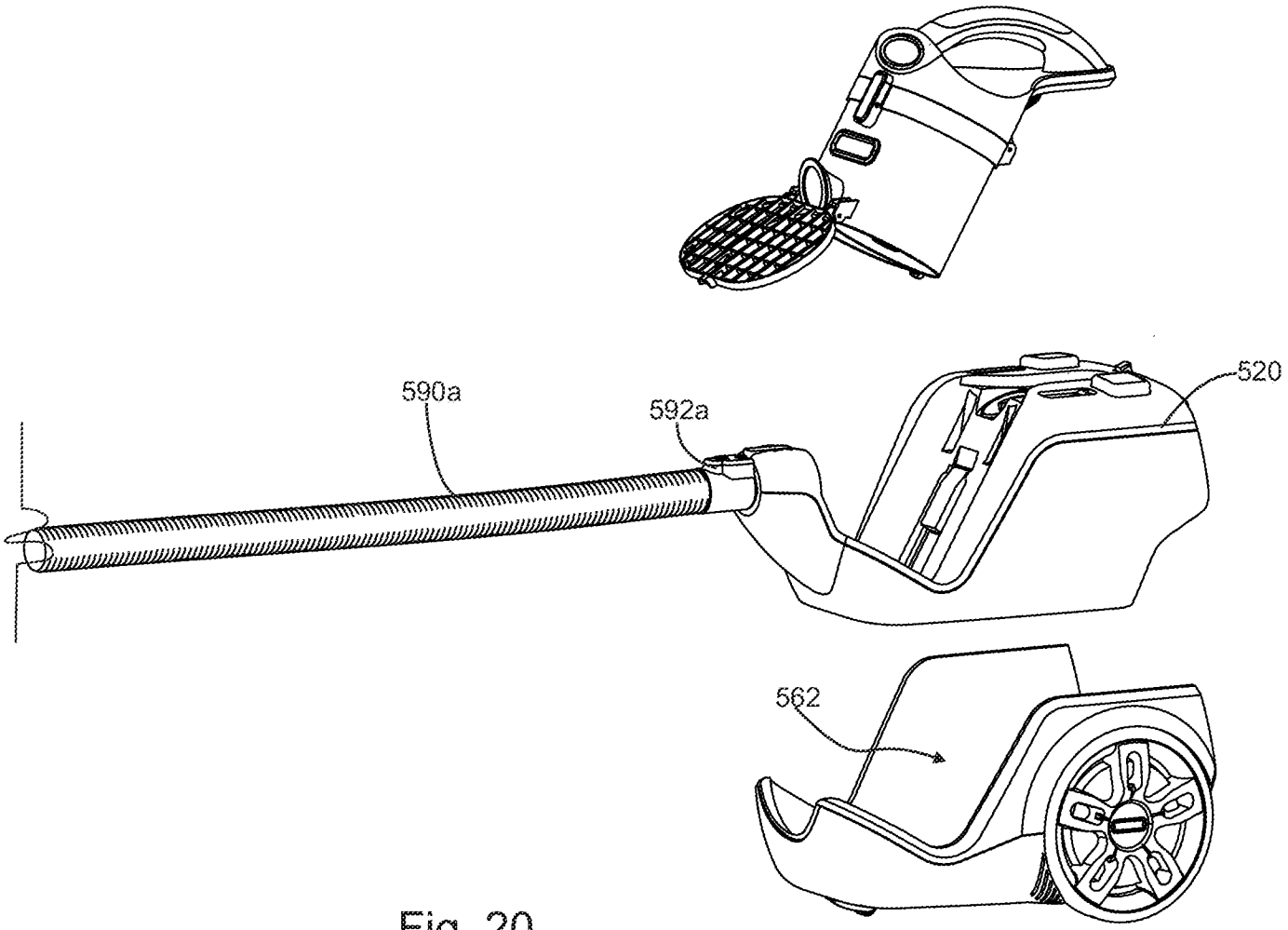
FIG. 20 is a perspective view of the surface cleaning apparatus of FIG. 18 with a surface cleaning unit detached and a cyclone bin assembly removed from the surface cleaning unit.

In this embodiment the cleaning unit 516 is mounted to a wheeled base 558. Wheeled base 558 comprises a plurality of wheels 560, and a cradle 562 (FIG. 20), which receives cleaning unit 516. The portable cleaning unit 516 can be operated while seated in the cradle 562 (FIG. 18) and can be lifted out of the cradle 562 and used as a hand carriable apparatus (FIG. 20).

Figure 21:
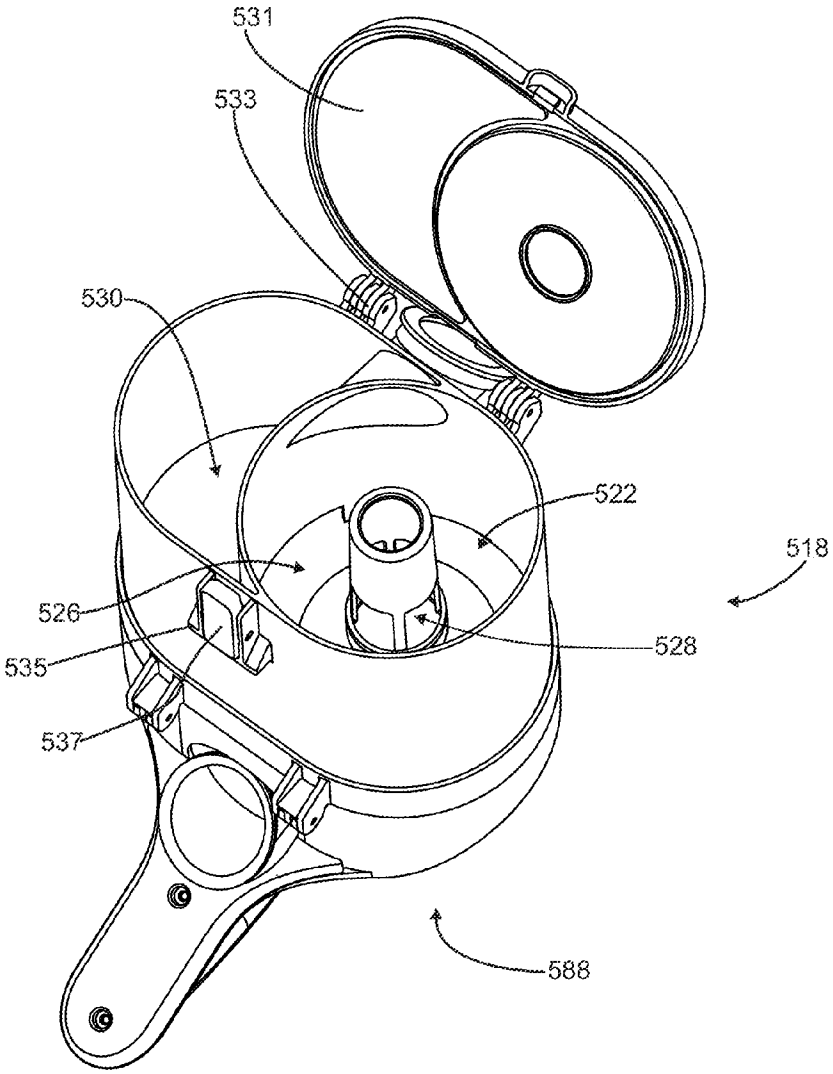
FIG. 21 is a bottom perspective view of the cyclone bin assembly of the surface cleaning apparatus of FIG. 18 in the open position.

Referring to FIG. 21, in this embodiment the cyclone cleaning stage 518 includes a cyclone chamber 522. Cyclone chamber 522 comprises a dirty air inlet 524 (FIG. 19), a separated or dirty material outlet 526, and a clean air outlet 528. A dirty or separated material collection chamber 530 is beside the cyclone chamber 522 and in communication with the dirty material outlet 526, for collecting material removed from the air in cyclone chamber 522.

Material collection chamber 530 may be of any configuration and may be emptied by a user in any manner known in the art. In the embodiment shown in FIG. 21, material collection chamber 530 has a bottom 531 that is openable by pivoting about a pivot pin 533. In this embodiment, material collection chamber further comprises a latch 535, for locking bottom 531 in place, and a button 537 for releasing the latch.

Figure 23:
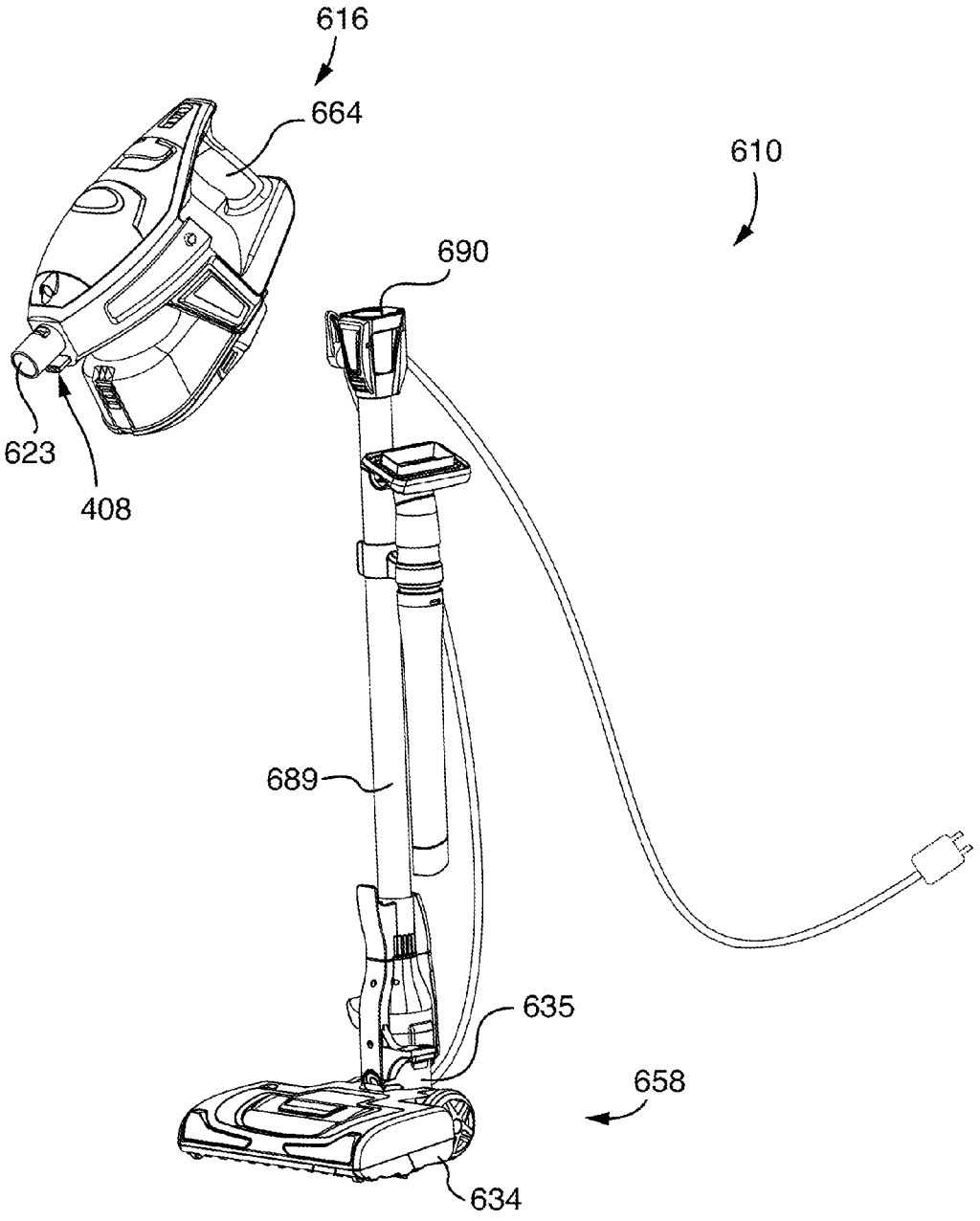
FIG. 23 is a perspective view of the surface cleaning apparatus of FIG. 22, with a portable cleaning unit disconnected from an upright section.
Figure 24:
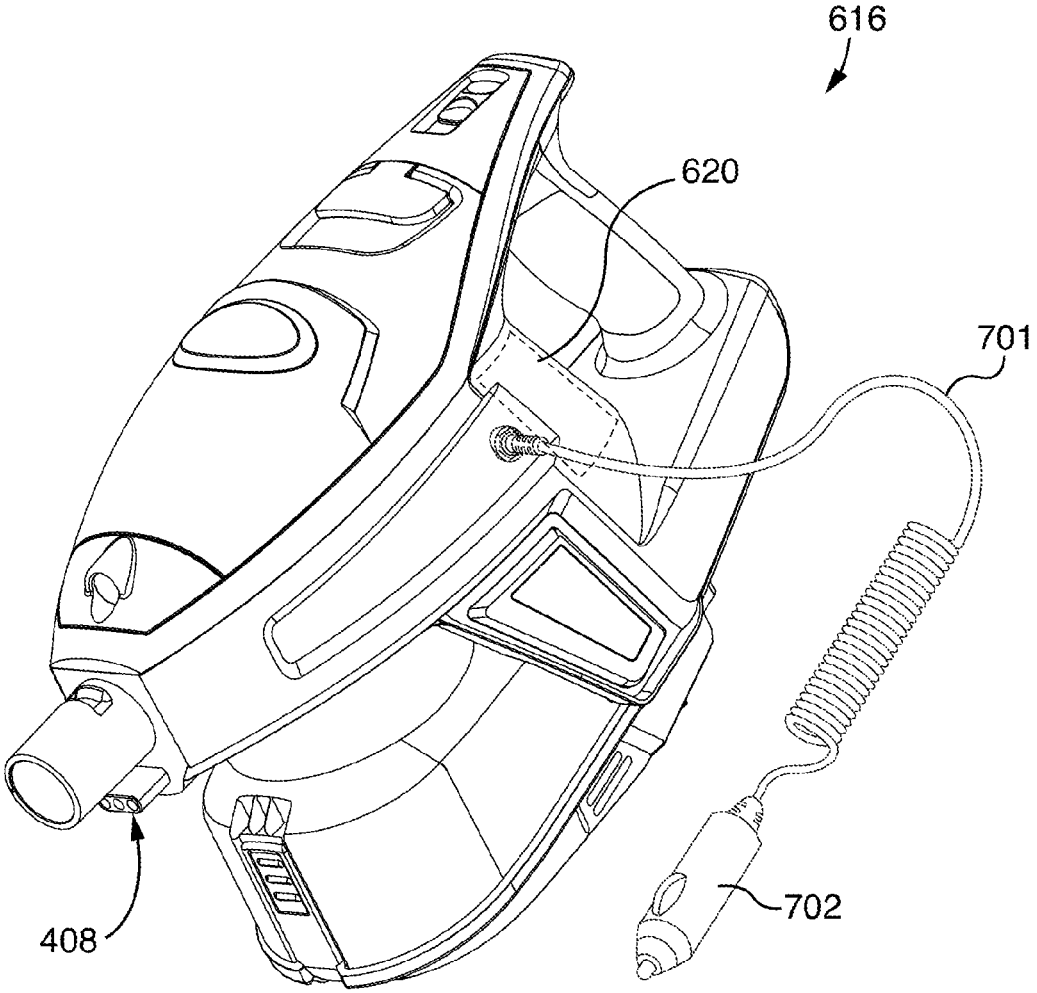
FIG. 24 is a perspective view of the portable cleaning unit of FIG. 23 connected with a DC power cord.
Figure 27:
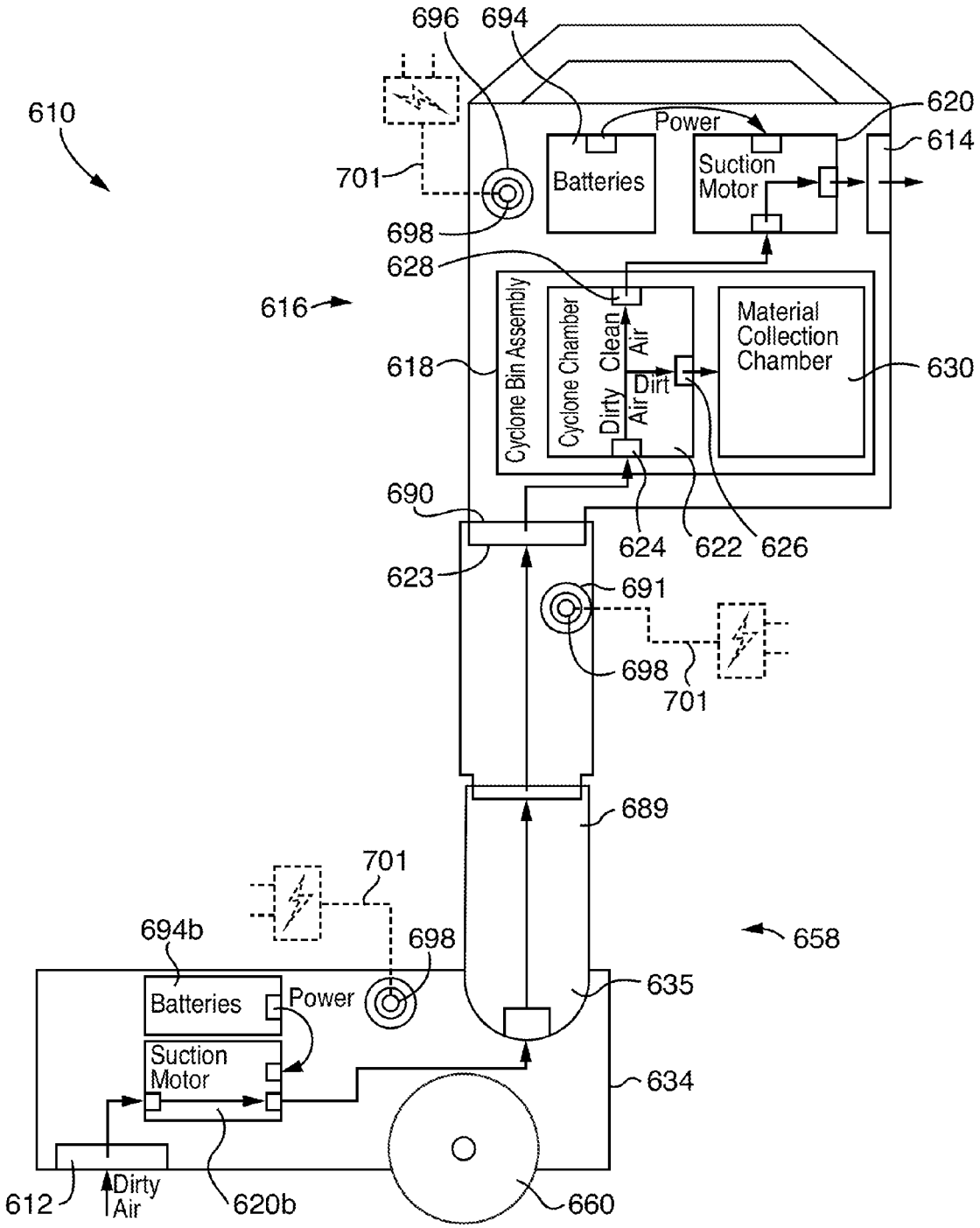
FIG. 27 is a schematic drawing of an embodiment of the surface cleaning apparatus of FIG. 22 showing several alternative power cord connections.

Referring to FIGS. 22-23, and 27, another embodiment of a surface cleaning apparatus 610 is shown. Apparatus 610 is generally similar to surface cleaning apparatus 10, and analogous features are identified using like reference characters indexed by 600. As shown, apparatus 610 may be a handheld surface cleaning apparatus ("handvac"), which is mountable to a base 658 comprising a surface cleaning head 634 and an upright section 689, which may also function as an above floor cleaning wand.

Referring to FIG. 22, surface cleaning apparatus 610 comprises a dirty fluid inlet 612, a clean air outlet 614, and a fluid flow path extending therebetween. A portable cleaning unit 616 is provided in the fluid flow path. Portable cleaning unit 616 comprises at least one cyclonic separation stage 618 (FIG. 27) for removing dirt from air, or for removing liquid from air or to pick up liquid. Cleaning unit 616 further comprises a portable cleaning unit suction motor 620 (FIG. 27) for drawing fluid through the portable cleaning unit (e.g., from the dirty fluid inlet 612 to the clean air outlet 614). Dirty fluid inlet 612 is provided in a member 634, which in this embodiment is a surface cleaning head.

In this embodiment, the cleaning unit 616 is mounted to upright section 689 which is moveably mounted to surface cleaning head 634 between a storage position and a reclined in use position, and may use any connection member (e.g., a pivot) as is known in the art. Surface cleaning head 634 may be a wheeled base comprising a plurality of wheels 660 (e.g. two rear wheels 660). Alternatively, surface cleaning head 634 may not include any wheels 660 (e.g. surface cleaning head 634 may slide over surfaces to be cleaned). Cleaning unit 616 may be connected to surface cleaning head 634 by an up flow conduit 689. An up flow conduit 689 may be pivotally connected to surface cleaning head 634 by a pivot joint 635. For example, up flow conduit 689 may be formed by or in pivot joint 635, or up flow conduit 689 may comprise a rigid extension conduit (e.g. wand) extending upwardly from pivot joint 635 as shown. The portable cleaning unit 616 can be operated while mounted to the conduit 689 (e.g. as a stick vac or stair cleaner) and can be disconnected from air flow communication with surface cleaning head 634 and used as a hand carriable apparatus (e.g. handvac, see FIG. 23) (e.g., it may be removed by itself from up flow conduit 689 (the upright section as exemplified) or it may be removed with up flow conduit 689).

Referring to FIG. 27, in this embodiment the cyclone cleaning stage 618 includes a cyclone chamber 622. Cyclone chamber 622 comprises a dirty air inlet 624, a separated or dirty material outlet 626, and a clean air outlet 628. A dirty or separated material collection chamber 630 is adjacent the cyclone chamber 622 and in communication with the dirty material outlet 626, for collecting material removed from the air in cyclone chamber 622. It will be appreciated that the cyclone cleaning stage may be of any design Material collection chamber 630 may be of any configuration and may be emptied by a user in any manner known in the art. In the embodiment shown in FIG. 22, material collection chamber 630 has an openable bottom 631.

Wheeled Base Construction

The following is a description of a wheeled base construction that may be used by itself in any surface cleaning apparatus or in any combination or sub-combination with any other feature or features disclosed herein.

Referring again to FIGS. 1-4, portable cleaning unit 16 is mounted to a wheeled base 58. Wheeled base 58 comprises a plurality of wheels 60, and a cradle 62, which receives cleaning unit 16.

Figure 5:
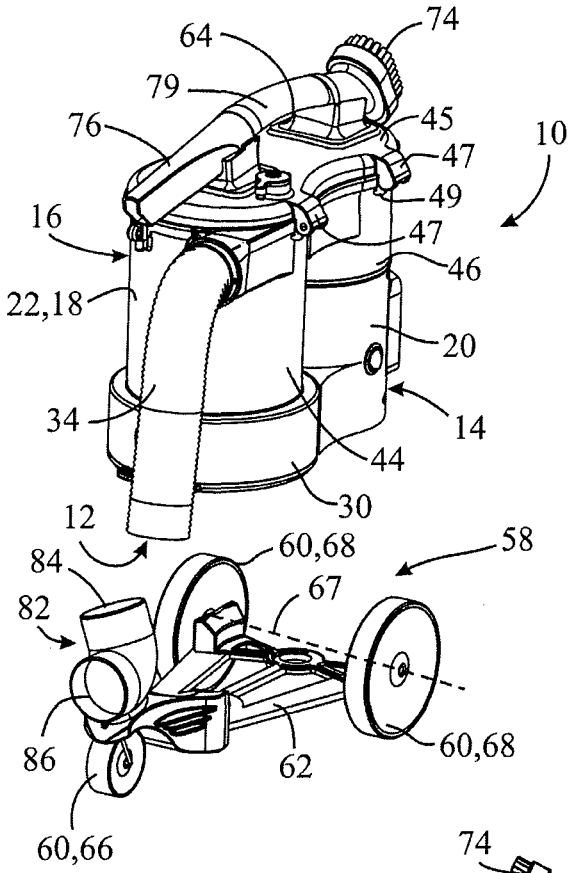
FIG. 5 is a perspective view of the embodiment of FIG. 1, showing a surface cleaning unit removed from a wheeled base.
Figure 6:
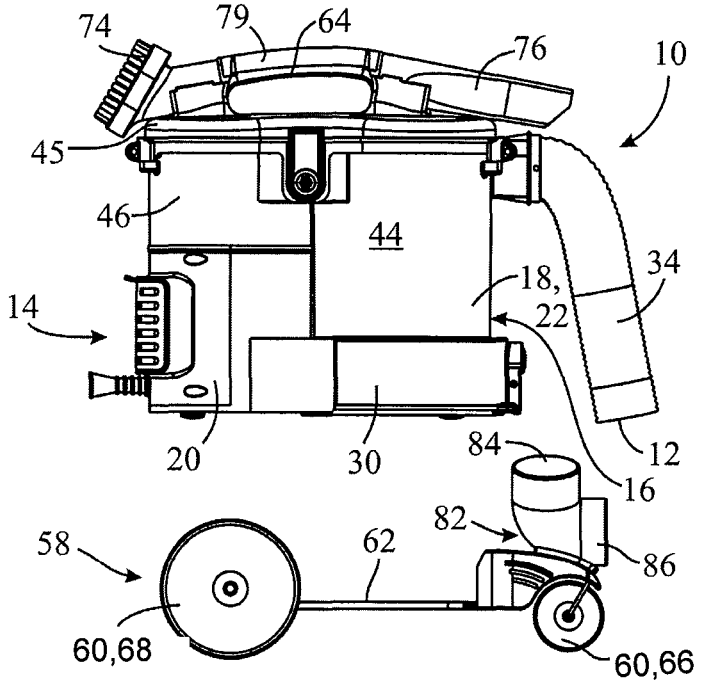
FIG. 6 is a side view of the embodiment of FIG. 1, showing a surface cleaning unit removed from a wheeled base.

In some embodiments, cleaning unit 16 may be permanently mounted to wheeled base 58, for example via one or more bolts. In other embodiments, cleaning unit 16 may be removably mounted to wheeled base 58. For example, a user may remove cleaning unit 16 from wheeled base in order to maneuver cleaning unit 16, or to empty material collection chamber 30. In such embodiments, cleaning unit 16 is portable. For example, as shown in FIGS. 5 and 6, cleaning unit 16 may be removed from wheeled base 58 by lifting cleaning unit 16 off of wheeled base 58.

In any embodiment, surface cleaning apparatus 10 may comprise a handle 64, and/or a shoulder strap 65 (shown in FIG. 8) for maneuvering cleaning unit 16 when it is removed from wheeled base 58. In some embodiments, handle 64 may be integrally formed with one or both of first 44 and second 46 housings.

Surface cleaning apparatus 10 may further comprise a locking member (not shown), such that cleaning unit 16 may be lockably received on wheeled base 58. The locking member may comprise any suitable locking member known in the art, such as, for example, a quick release latch, a friction or snap fit, a set screw, a tie down strap (e.g., a strap which may be wrapped around cleaning unit 16) or the like. The lock may be actuatable by a foot pedal. Alternately wheeled base 58 may have side wall extending up around cradle 62 within which portable cleaning unit 16 is received. It will be appreciated that cradle 64 may be any member on which portable cleaning unit 16 may be received or secured, such as a flat base with or without side walls.

In the embodiments exemplified, wheeled base 58 comprises a front wheel 66, and two rear wheels 68*a*, 68*b*. Accordingly, cradle 62 is a platform that is generally polygonal and, preferably, generally triangular in configuration. This configuration may provide increased maneuverability to surface cleaning apparatus 10. In other embodiments, wheeled base 58 may comprise another number of wheels. For example, in some embodiments, wheeled base 58 may comprise two front wheels and two rear wheels. It will be appreciated that, as exemplified, housings 44, 46 may be oriented on cradle 62 with the suction motor at the rearward end of portable cleaning unit 16 and the inlet to portable cleaning unit 16 at the forward end of the front housing. In alternate configurations, housings 44, 46 may be positioned side by side. Further, if more than two housings 44, 46 are provided, then the housings may be arranged linearly, in a triangular configuration or any other desired configuration.

In some embodiments, front wheel 66 is rotatably mounted about a vertical axis to cradle 62 (e.g., is a caster wheel), and rear wheels are non-rotatably mounted about a vertical axis. Accordingly, front wheel 66 may be steerable. In other embodiments, all of front wheel 66 and rear wheels 68 may be caster wheels, or may be non-rotatably mounted wheels.

In some embodiments, wheeled base 58 has a length greater than its width. That is, the distance L between front wheel 66 and axis 67 extending between rear wheels 68*a*, 68*b*, is greater than the distance W between rear wheels 68*a*, 68*b*, along axis 67. In other embodiments, wheeled base 58 may have a width W greater than its length L, or may have width W equal to its length L.

In the embodiments shown, front wheel 66 is of a smaller diameter than rear wheels 68*a*, 68*b*. Alternately, rear wheels 68*a*, 68*b* may be smaller than front wheel 66. Preferably, both the front and rear wheels are each relatively large. For example, in some embodiments, front wheel(s) may have a diameter of between about 0.5-4 inches, preferably 1-3 inches and more preferably 1.5-2.5 inches. In some embodiments, rear wheels may have a diameter of between about 0.5-4 inches, preferably 1-3 inches and more preferably 1.5-2.5 inches. In one particular embodiment, both front wheel(s) 66 and rear wheels 68*a*, 68*b* have a diameter in the same range. Such embodiments may be advantageous to provide surface cleaning apparatus 10 with increased maneuverability and with increased stability.

In the embodiments shown, wheeled base 58 is configured such that, when cleaning unit 16 is mounted on cradle 62, rear wheels 58 are positioned outwardly of cleaning unit 16. That is, rear wheels 58 are separated by a distance W that is greater than the width W' of cleaning unit 16. Such embodiments may provide surface cleaning apparatus 10 with a wider stance, and accordingly with increased stability. Additionally, because rear wheels 68 are positioned outwardly of cleaning unit 16, rear wheels 68 may be provided with an increased diameter, as previously mentioned, without increasing the distance between cleaning unit 16 and a surface such as a floor. Accordingly, the center of mass of cleaning unit 16 may remain low, which further increases the stability of surface cleaning apparatus 10.

Figure 17:
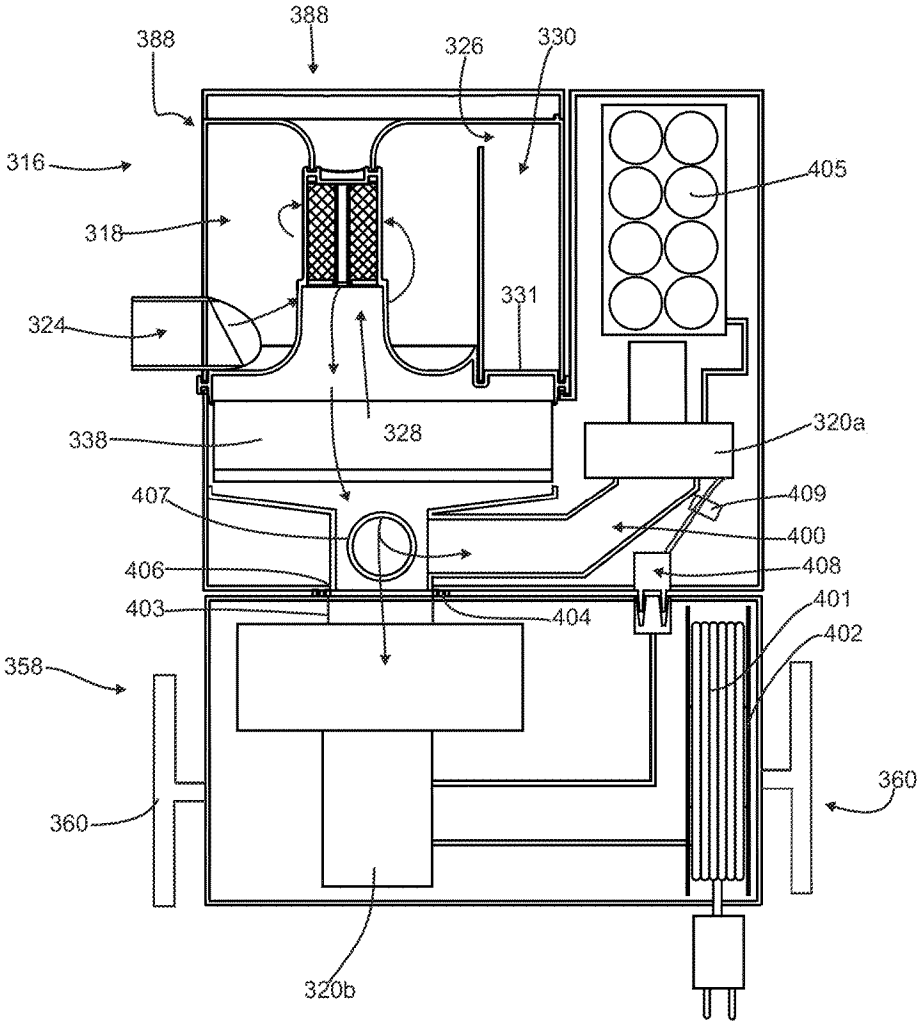
FIG. 17 is a schematic representation of another embodiment of a surface cleaning apparatus.

In some embodiments, wheeled base 58 may comprise operating components of surface cleaning apparatus 10, such as a suction motor (see FIG. 17). For example, wheeled base may comprise a portion that is provided in the fluid flow path, and includes a filter assembly (not shown). In other embodiments, as exemplified, wheeled base 58 may not comprise any operating components (i.e. wheeled base has an absence of operating components).

In the embodiments shown, cleaning unit 16 is oriented such that dirty fluid inlet 12 is provided at a front end 70 of surface cleaning apparatus 10, adjacent front wheel 66, and suction motor 20 is provided at a rear end 72 of surface cleaning apparatus 10, adjacent rear wheels 68. In other embodiments, cleaning unit 16 may be otherwise oriented. For example, suction motor 20 may be provided at front end 70, and dirty fluid inlet 12 may be provided at rear end 72. Alternatively, cleaning unit 16 may be oriented such that suction motor 20 and dirty fluid inlet 12 are equally spaced from front wheel 66 and rear wheels 68. That is, cleaning unit 16 may be positioned substantially sideways in wheeled base 58.

In some embodiments, portable cleaning unit 16 may be connected to a remote surface cleaning head by connected in air flow communication with the wheeled base, wherein the remote surface cleaning head may be connected or removably connected in air flow communication with the wheeled base. Accordingly, when portable cleaning unit 16 is placed on the wheeled base, it may be automatically connected in air flow communication with the wheeled base (see for example FIGS. 15, 17 and 19) or the user may have to connect portable cleaning unit 16 in air flow communication with the wheeled base, such as by connecting a hose of portable cleaning unit 16 in air flow communication with an air outlet of the wheeled base (see for example FIGS. 5 and 6).

As exemplified in FIGS. 5 and 6, wheeled base 62 may comprise a floor cleaning mount 82 coupled to cradle 62. A first end 84 of mount 82 is configured for receiving member 34, which, in the embodiments exemplified in FIGS. 1-6, is a hose. A second end 86 of mount 82 is configured for receiving another member, for example a remote surface cleaning head that is preferably at the distal end of a wand and a flexible hose extends between the wand and mount 82 (not shown). It will be appreciated that portable cleaning unit 16 may be designed such that the inlet of the portable cleaning unit automatically is connected in flow communication with mount 82 when portable cleaning unit 16 is positioned on wheeled base 58, such as by use of an inlet port aligned with first end 84 or a rigid pipe that is fittable thereon. Alternately, as exemplified, a flexible hose 34 that is manually insertable may be used. An advantage of this design is that the attachment member for a wand or the like is provided on the platform and not the portable cleaning unit. Therefore, the wand may be used to pull wheeled base 58 without risk of pulling portable cleaning unit 16 off of wheeled base 58. Further, preferably the attachment point is close to the floor, preferably at the level of cradle 62, thereby lowering the point at which wheeled base 58 may be pulled and increasing the stability of wheeled base 58 when it is being pulled.

It will be appreciated that in the portable mode, a wand or flexible hose and wand, or other member known in the art may be attached to hose 34 or hose 34 may be removed and the wand or flexible hose and wand, or other member known in the art may be attached directly to the inlet to housing 44.

In some embodiments, one or more accessories, such as cleaning brush 74 and wand extension 76 may be secured to the upper surface of lid 45, such as by means of mounts 78. Accordingly, extension 76 may be configured to function as a handle (e.g. central section 76 may be arcuate in shape or be spaced from lid 45), to define an opening 80 between the upper surface of lid 34 such that extension 76 of brush 74 may be a carry handle 64 for the vacuum cleaner. Alternately, extension 76 may be configured to seat on handle 64 and permit handle 64 to be used when brush 74 is mounted on portable cleaning unit 16. In other embodiments, one or more accessories may be provided in a recess in the lower surface of portable cleaning unit 16 or in an upper surface of wheeled base 58.

Figure 28:
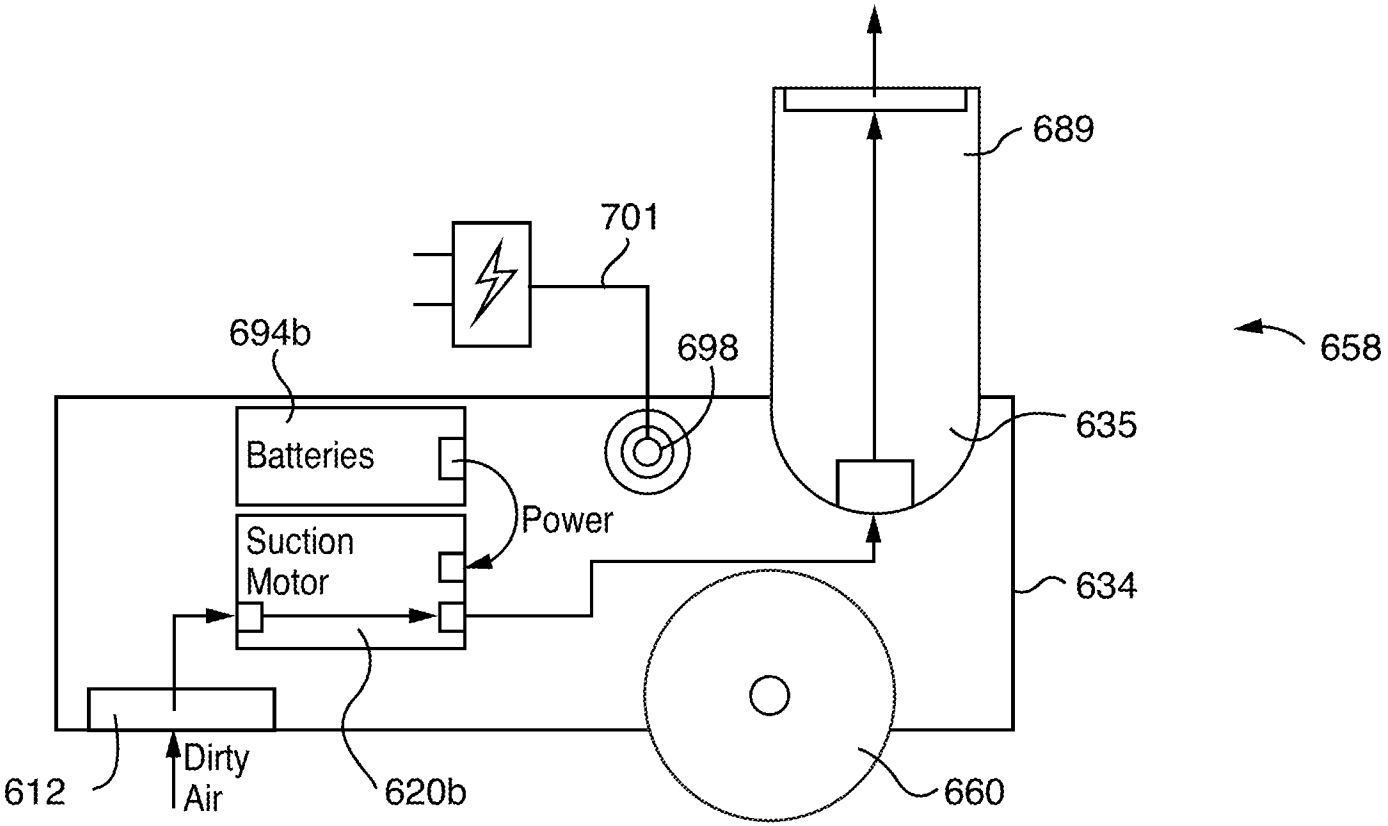
FIG. 28 is a schematic drawing of the surface cleaning head of FIG. 23; and, FIG. 29 is a schematic drawing of an embodiment of the portable cleaning unit of FIG. 23.

Referring to FIGS. 22 and 28, portable cleaning unit 616 is mountable to base 658. base 658 comprises a surface cleaning head 634, and an up flow conduit 689 to which cleaning unit 616 is mountable. As exemplified, cleaning unit 616 is removably mounted to base 658. For example, a user may remove cleaning unit 616 from base 658 in order to use cleaning unit 616 as a handvac, or to empty material collection chamber 630.

As shown, cleaning unit 616 may have a handle 664 for maneuvering cleaning unit 616 when it is connected to base 658 and when it is removed from base 658 (FIG. 23). Surface cleaning apparatus 610 may further comprise a locking member 625, such that cleaning unit 616 may be lockably mounted to base 658.

Referring to FIGS. 27 and 28, base 658 may comprise operating components of surface cleaning apparatus 610, such as an upstream suction motor 620*b*. Suction motor 620*b* may be a dirty air suction motor that is positioned in the airflow path downstream of dirty fluid inlet 612 and upstream of clean air outlet 614, such as upstream of up flow conduit 689. In other embodiments (e.g., in the surface cleaning head or on the up flow conduit).

As exemplified in FIGS. 23 and 27, portable cleaning unit 616 may include an inlet end 623, which may be formed as a nozzle as shown. Inlet end 623 may be fluidly connected to a downstream end 690 of up flow conduit 689 in a suitable manner (including any suitable manner known in the art) for mounting portable cleaning unit 616 to base 658.

Removable Dirt Chamber

The following is a description of a portable cleaning unit having a removable dirt chamber that may be used by itself in any surface cleaning apparatus or in any combination or sub-combination with any other feature or features disclosed herein.

As exemplified in FIG. 14, the cyclone chamber 118 and material collection chamber 130 may be constructed as a one piece assembly and are referred to collectively as a cyclone bin assembly 188. In accordance with this aspect, cyclone bin assembly 188 may be removed from the portable surface cleaning unit 116 when the portable surface cleaning unit 116 is seated on the base 158 (FIGS. 14 and 19) and when the portable surface cleaning unit 116 is separated from the base 158 (FIG. 13). This may allow a user to remove only the cyclone bin assembly 188, for example for emptying, regardless of whether the surface cleaning unit 116 is docked on the base 158.

As exemplified in FIGS. 18-21, the material collection chamber 530 may be movable or removable from surface cleaning apparatus 510 and from the portable cleaning unit 516, such that it may be emptied, and is removable from portable cleaning unit 516 with the associated cyclone 518 or cyclones as a sealed unit.

In the illustrated embodiment, the cyclone chamber 518 and material collection chamber 530, referred to collectively as a cyclone bin assembly 588, can be removed from the portable surface cleaning unit 516 when the portable surface cleaning unit 516 is seated on the base 558 (FIG. 19) and when the portable surface cleaning unit 516 is separated from the base 558 (FIG. 20). This may allow a user to remove only the cyclone bin assembly 588, for example for emptying, regardless of whether the surface cleaning unit 516 is docked on the base 558.

Referring to FIG. 18, in the illustrated embodiment, when the surface cleaning unit 516 is mounted on the base 558 the air flow path between the surface cleaning head 534 and the suction motor in the surface cleaning unit 516 includes a rigid conduit 589, a flexible hose 590*a*.

In this embodiment, the first hose 190*a* is connected to the surface cleaning unit 516 and extends between a downstream end 592*a* (with reference to the direction of airflow through the hose 590*a*) that is connected to the surface cleaning unit 516 and the rigid conduit 589. In this configuration, when the surface cleaning unit 516 is removed from the base 558 the hose 590*a* comes with the surface cleaning unit 516 (FIG. 20).

It will be appreciated that, in alternate embodiments, material collection chamber 130 may be a separate unit and may be removable without the cyclone chamber. Alternately, or in addition, material collection chamber 130 may be removed with the handle of the portable cleaning unit. An advantage of this design is that the handle of the portable cleaning unit may be useable to manipulate the material collection chamber 130 or cyclone bin assembly when removed for emptying.

Automatic Portable Cleaning Unit Hose Connection

The following is a description of automatically connecting a hose of the portable cleaning unit in air flow communication with the base when the portable cleaning unit is placed on the base that may be used by itself in any surface cleaning apparatus or in any combination or sub-combination with any other feature or features disclosed herein.

Referring to FIG. 12, in the illustrated embodiment, when the surface cleaning unit 116 is mounted on the base 158, the air flow path between the remote surface cleaning head 134 and the suction motor in the surface cleaning unit 116 includes a rigid conduit or wand 189, a first flexible hose 190*a* and a second flexible hose 190*b* (see also FIG. 14) positioned downstream from the first hose 190*a*.

The first hose 190*a* extends from its upstream that is connected to rigid conduit 189 to its downstream end 192*a* (with reference to the direction of airflow through the hose 190*a*) that is connected to the base 158. The first hose 190*a* has a diameter 191*a*. While the first hose 190*a* may be removably connectable to the base 158, first hose 109*a* remains attached to the base 158 regardless of the position of the surface cleaning unit 116 (FIGS. 12 and 14).

Referring to FIG. 13, the second hose 190*b* is attached to and is removable with the surface cleaning unit 116. A downstream end 192*b* of the hose 190*b* is attached to the air inlet 124 of the cyclone chamber 118 and the upstream end

193*b* is removably connectable in air flow communication with the air outlet of the base 158 (e.g., opening 195 of coupling 194). When the surface cleaning unit 116 is removed from the base 158, the upstream or inlet end 193*b* of the hose 190*b* can be used as a second or auxiliary dirty air inlet for drawing fluid and debris into the air flow path. Optionally, auxiliary cleaning tools may be attached to the inlet end 193*b* of the hose 190*b*. In this configuration, the first hose 190*a* does not form part of the airflow path to the surface cleaning unit 116.

The second hose 190*b* is shown in a wrapped or storage position in FIG. 13 in which it is wrapped around part of the surface cleaning unit 116. When the surface cleaning unit 116 is in use as a portable cleaning unit the second hose 190*b* can be unwound and extended. Preferably, the second hose 190*b* is extensible to increase its cleaning range. The second hose 190*b* has a diameter 191*b*, which optionally may be smaller than diameter 191*a*. This may help reduce the overall size of the surface cleaning unit 116 and may help it nest on the base 158. However, it is preferred that they have the same or similar diameters so as to provide an air flow path that has a generally constant diameter. The hoses 190*a* and 190*b* may be generally similar. Alternatively, they may have different properties. For example, the first hose 190*a* may be non-extensible and relatively stiff (to allow a user to pull the hose 190*a* to advance the base 158 across the surface) and the second hose 190*b* may be extensible and less stiff.

Referring to FIG. 12, when the surface cleaning unit 116 is seated on the base 158, the inlet end 193*b* of the second hose 190*b* is connected in air flow communication with the downstream end 192*a* of the first hose 190*a*, using coupling 194, thereby re-establishing air flow communication between the cleaning head 134 and the surface cleaning unit 116.

Referring to FIG. 13, the coupling 194 may be any suitable connector, and in the example illustrated, is an elbow-type connector with a downstream opening 195 surrounded by a sealing face 196. The surface cleaning unit 116 may be configured such that the upstream end 193*b* of the second hose 190*b* is aligned with the opening 195 and seals against seal face 196 to establish the air flow path when the surface cleaning unit 116 is placed on base 158. Accordingly, sealing face 196 is sealed by the inlet end 193*b* automatically when the surface cleaning unit 116 is inserted vertically onto the base 158.

In order to provide a seal, one or both of base 158 and surface cleaning unit 116 may be configured to provide sufficient abutment therebetween so that an air tight seal is created. As exemplified in FIG. 13, the rear face of coupling 194 is angled and a mating angled surface may be provided on portable cleaning unit 116. Accordingly, when portable cleaning unit is placed on base 158, portable cleaning unit is urged rearwardly and the rear end of portable cleaning unit 116 may abut the rear wall of base 158 thereby pressing the upstream end 193*b* of the second hose 190*b* against the opening 195 and optionally compressing a gasket or the like to create an air tight seal.

Figure 19:
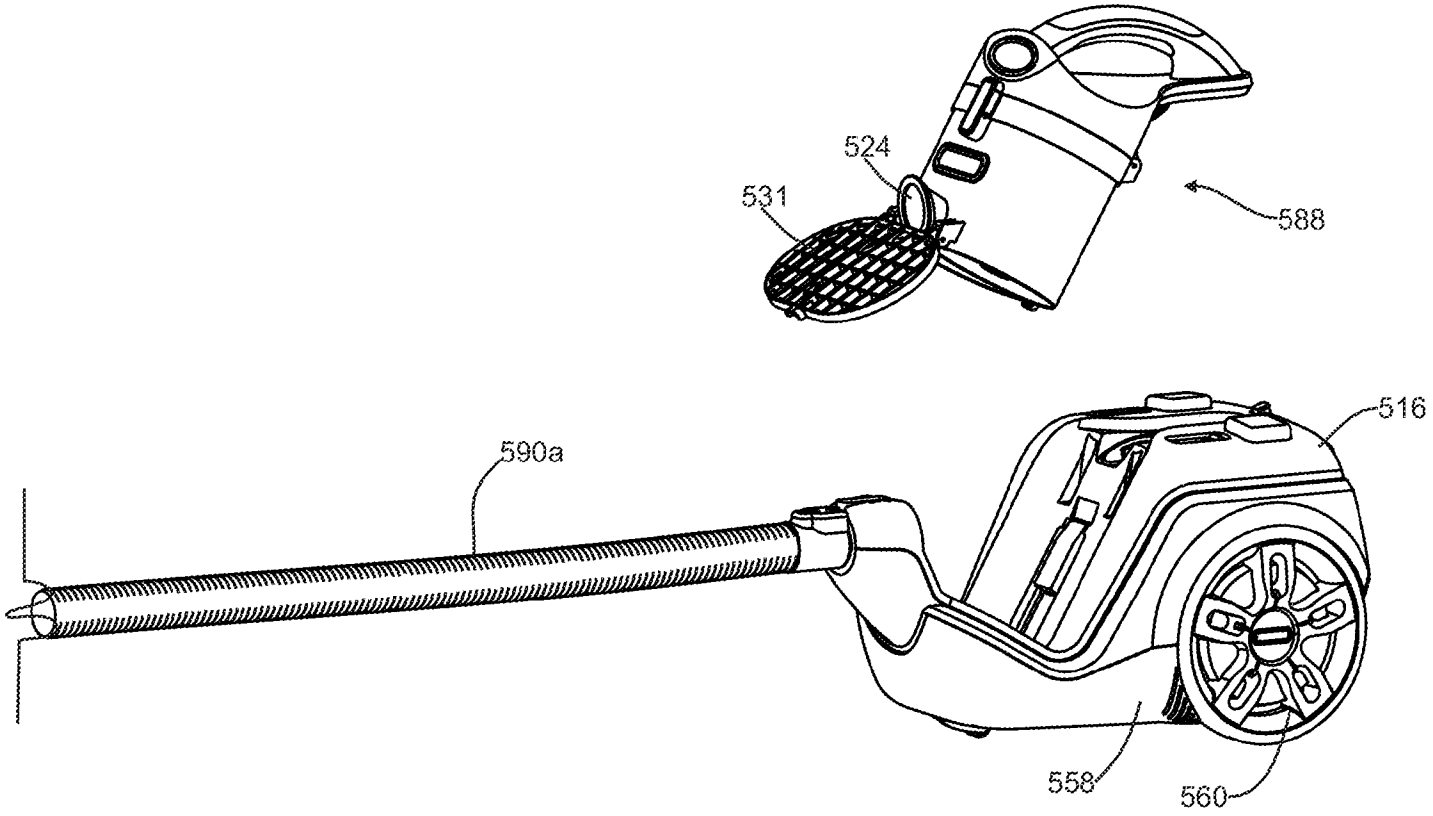
FIG. 19 is another perspective view of the surface cleaning apparatus of FIG. 18 with a cyclone bin assembly removed.

If the cyclone bin assembly is removable, then the remaining body of portable cleaning unit 116 may also or alternately be angled to press the cyclone inlet 524 against opening 195 (see for example FIG. 19).

Valve to Switch Between Hoses

The following is a description of alternate air flow paths that may be used by itself in any surface cleaning apparatus or in any combination or sub-combination with any other feature or features disclosed herein.

In accordance with this aspect, the portable cleaning unit may incorporate a hose which is different to first hose 190*a*. For example, it may have a smaller diameter. Accordingly, it may be preferred not to use such a hose in the air flow path when portable cleaning unit 116 is mounted on the base since the smaller diameter hose would reduce air flow and increase the back pressure. However, the smaller diameter hose may be lighter and easier to use in a portable mode (i.e., when surface cleaning unit 116 is removed from base 158). In such a case, a valve may be provided to selective connect the cyclone air inlet with the different hoses or air flow paths. The valve may be manually operable or automatically operable. For example, the valve may be actuated automatically when the surface cleaning unit 116 is removed from the base or when the smaller diameter hose is deployed from a storage position for use.

Accordingly, if second hose 190*b* has a smaller diameter into the air flow path when the surface cleaning unit 116 is docked, a user may optionally detach the downstream end 192*b* of the second hose 190*a* from the air inlet 124 (thereby removing the second hose 190*b* from the air flow circuit) and can reposition the downstream end 192*a* of the hose 190*a* to be connected directly to the inlet 124. Alternately, inlet 124 could be automatically connected in air flow communication with opening 195 when surface cleaning unit 116 is placed on base 158.

Optionally, instead requiring a user to reconfigure a hose, the surface cleaning apparatus may include a valve positioned in the air flow path that allows the air flow to be switched between the first and second hoses. In this configuration, both hoses can remain attached to their respective components, and the air flow path to the surface cleaning unit 116 can include either of the first and second hoses. Optionally, one of the hoses may be detachable and connectable to the other of the hoses, such that one large hose is created and forms the air flow path to the surface cleaning unit.

Figure 15:
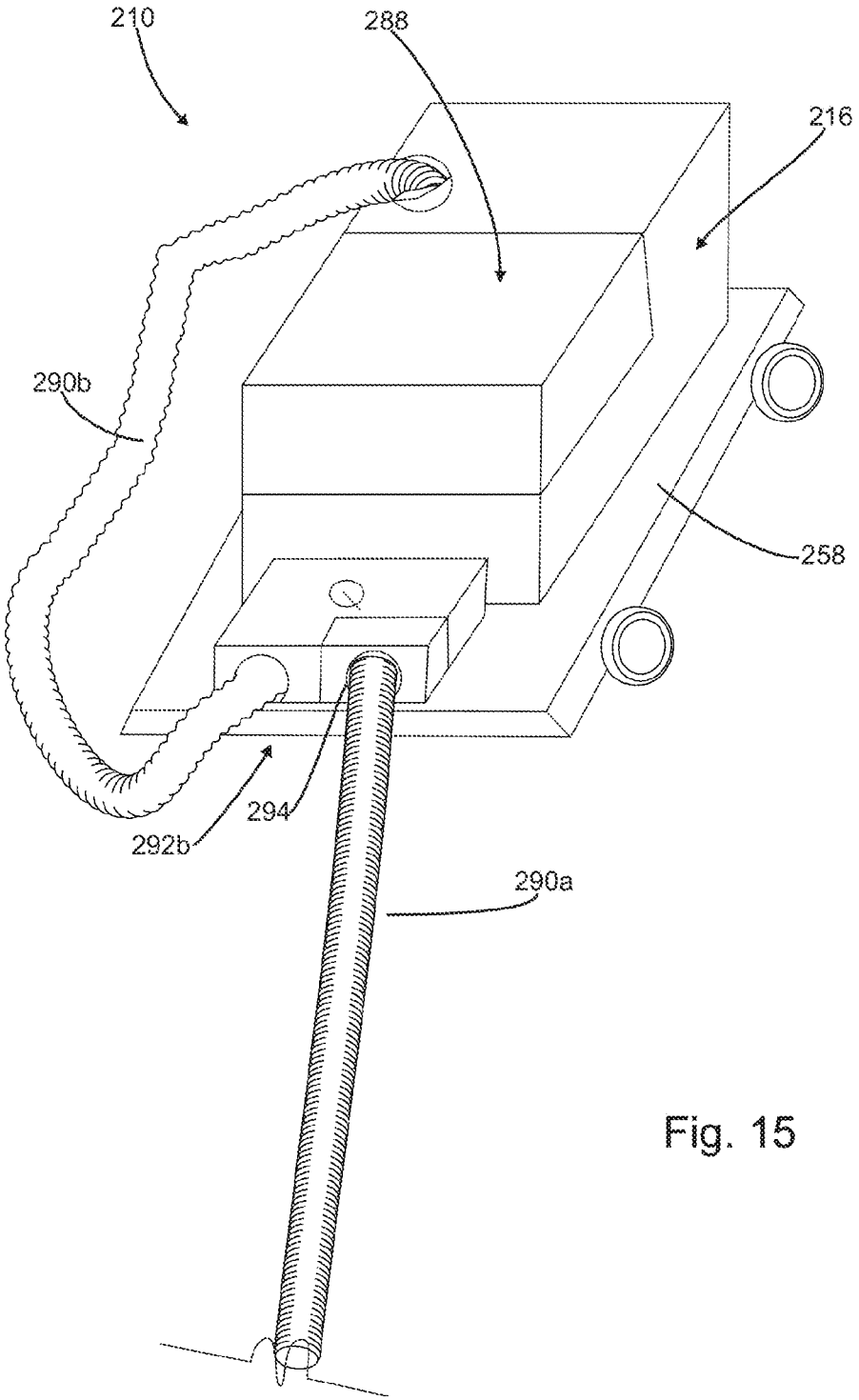
FIG. 15 is a schematic representation of another embodiment of a surface cleaning apparatus.
Figure 16:
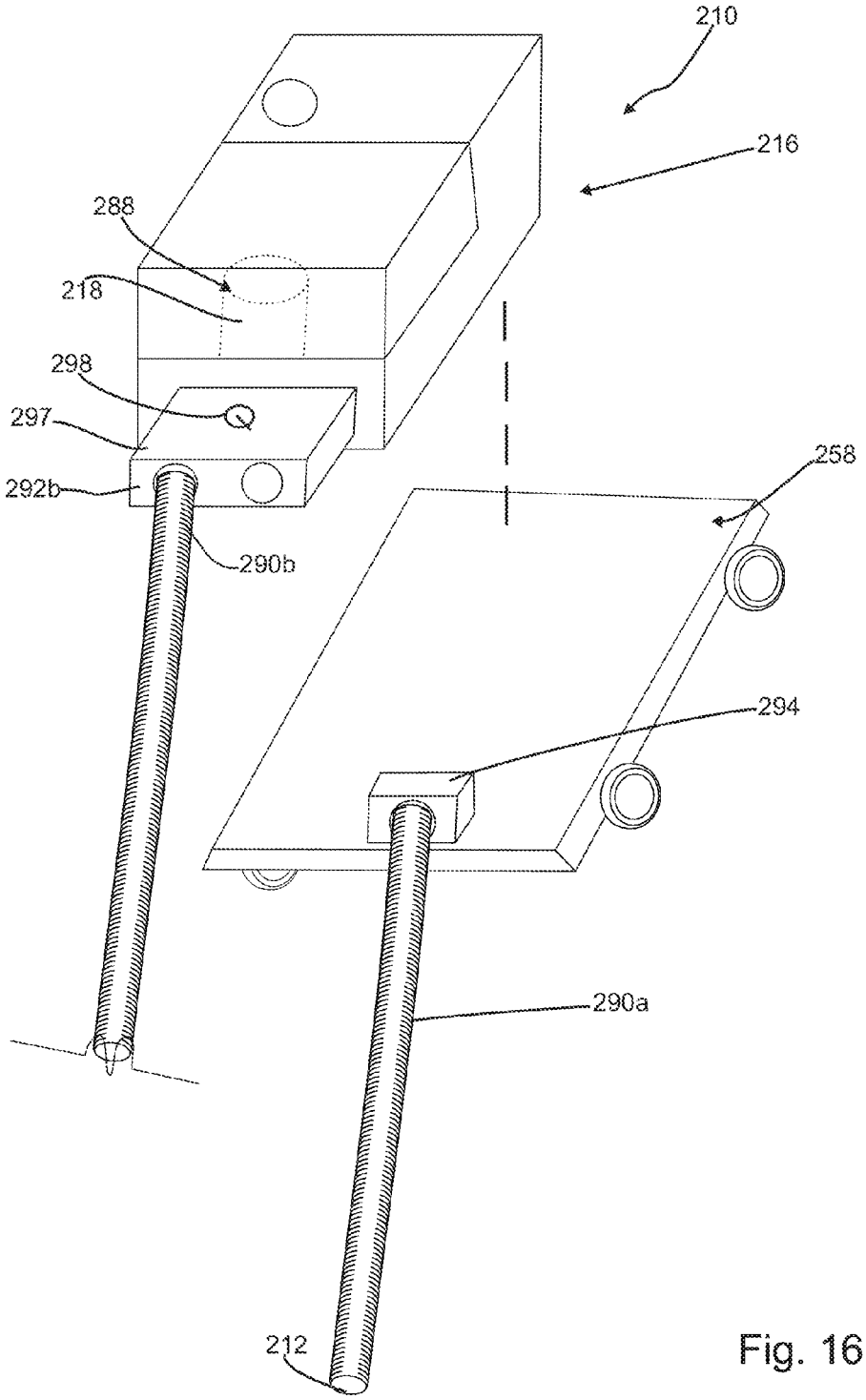
FIG. 16 is a schematic representation of the surface cleaning apparatus of FIG. 15 with a surface cleaning unit detached.

Referring to FIGS. 15 and 16, a schematic representation of another embodiment of a surface cleaning apparatus 210 is illustrated. Surface cleaning apparatus 210 is generally similar to apparatus 10, and analogous features are identified using like reference characters indexed by 200.

In this embodiment, the surface cleaning unit 216 includes a valve 297 provided in the air flow path, upstream from the air inlet of the cyclone chamber 218. The valve is connected to the downstream end 292*b* of the second hose 290*b*, and the valve 297 and second hose 290*b* are removable with the surface cleaning unit 216 (FIG. 16). When the surface cleaning unit 216 is seated on base 258, the valve can connect to coupling 294 automatically or manually. An actuating lever 298 allows a user to change to position of the valve 297 so that, when the surface cleaning unit 216 is docked, the first hose 290*a* is connected in air flow communication with the surface cleaning unit 216 and the second hose 290*b* is sealed (but remains attached and does not require re-configuration). Optionally, the valve 297 can be automatically actuated when the surface cleaning unit 216 is placed on or removed from the base 258 to adjust the air flow path accordingly.

Use of Dual Suction Motors

The following is a description of the use of dual suction motors that may be used by itself in any surface cleaning apparatus or in any combination or sub-combination with any other feature or features disclosed herein.

Optionally, the base of the surface cleaning apparatus may include some operating components of the surface cleaning apparatus, including, for example a suction motor, the power cord and a cord reel. Providing components in the base may help reduce the weight and/or overall size of the portable surface cleaning unit.

Referring to FIG. 17, a schematic representation of another embodiment of a surface cleaning apparatus 310 is shown. The surface cleaning apparatus 310 is generally similar to surface cleaning apparatus 10, and analogous features are identified using like reference characters indexed by 300.

In the illustrated embodiment, the surface cleaning apparatus 310 includes a base 358 and a surface cleaning unit 316 that can be mounted on the base 358 (as illustrated), and can be detached to be used separately from the base 358.

The surface cleaning unit 316 includes a cyclone bin assembly 388 that has a cyclone chamber 318 and a dirt collection chamber 330. The cyclone chamber 318 has an air inlet 324 and an air outlet 328. A dirt outlet in the form of a slot 326 provides communication between the cyclone chamber 318 and the dirt collection chamber 330.

A first suction motor 320*a* is provided in the surface cleaning unit 316. An air flow conduit 400 provides an air flow path between the air outlet of the pre-motor filter housing and the suction motor 320*a*. Accordingly, a pre-motor filter 338 is provided in the air flow path between the air outlet 328 of the cyclone chamber 318 and the motor 320*a*.

In the illustrated embodiment the electrical cord 401 is wound around a cord reel 402 that is provided in the base 358. In addition, a second suction motor 320*b* is provided in the base 358 and is in electrical communication with the power cord 401 such that the second suction motor 358 can be powered by an external power supply (e.g. a wall socket). A base conduit 403 provides air flow communication between the second suction motor 320*b* and a port 404 on the upper surface of the base 358.

When the surface cleaning unit 316 is mounted on the base 358, a mating port 406 on the surface cleaning unit 316 may connect to and seal the port 404. Preferably, a valve 407 (e.g. any suitable valve such as a two position valve and a ball valve) is provided, e.g., in the air flow path between the filter 338 and the motor 320*a*. The valve 407 is also in air flow communication with the port 406, and is operable to selectively connect either port 406 or conduit 400 in airflow communication with the cyclone bin assembly 388. When conduit 400 is connected, suction motor 320*a* may be used draw air through the surface cleaning unit 316 (and preferably motor 320*b* is not). When port 406 is connected, suction motor 320*b* may be used to draw air through the surface cleaning unit 316 (and preferably motor 320*a* is not). Preferably, the valve 407 is configured (for example via a biasing member or linkage member) so that when the surface cleaning unit 316 is lifted off the base 358 the valve 407 automatically seals port 406 and connects conduit 400.

It will be appreciated that valve may be actuatable by other means, such as a member that is drivingly connected to the valve and the member is operable as the surface cleaning unit is paced and or removed from base 358. It will be appreciated that motor 320*b* may be connected in air flow communication at an alternate location. For example, it could be downstream of motor 320*a*. Alternately, it could be a dirty air motor and located upstream of cyclone chamber 318.

Because the electrical cord 401 is provided in the base 358, when the surface cleaning unit 316 is detached from the base 358, it may no longer be connected to the external power source (e.g. wall socket). To provide power to the surface cleaning unit 316 when it is detached, the surface cleaning unit 316 includes an on-board energy storage member, e.g., one or more batteries 405. Alternatively, any other suitable energy storage member or power source can be used (fuel cell, combustion engine, solar cells, etc.). In the illustrated example, the batteries 405 provide DC power. In this configuration, when the surface cleaning unit 316 is detached from base 358, the suction motor 320*a* may operate using DC power, and may operate solely on the power supplied by batteries 405.

Optionally, when the surface cleaning unit 316 is re-attached to the base 358, power from the base 358 can be transferred to the surface cleaning unit 316, for example via detachable electrical connector 408. Preferably, if an electrical connector 408 is provided the power received from the base 358 can be used to charge the batteries 405 to help ensure the batteries 405 are charged when the surface cleaning unit 316 is removed.

Alternatively, there need not be an electrical connection between the base 358 and the surface cleaning unit 316. In such a configuration the batteries 405 may be charged via an alternate power source, or may be replaced with fresh batteries as needed. For example, the surface cleaning unit 116 may be provided with its own power cord, or the power cord 401 may be removable from base 358 and may be plugged into surface cleaning unit 116.

Optionally, the suction motor 320*a* may be smaller and/or less powerful than the suction motor 320*b*. Making the suction motor 320*a* smaller and lighter than suction motor 320*b* may help reduce the overall size and weight of the surface cleaning unit 316. For example, the suction motor 320*b* may be a 1000 watt motor, and the suction motor 320*a* may be a 600 watt motor. Reducing the power consumption of the suction motor 320*a* may also help prolong the amount of cleaning time that can be achieved using the batteries 405, before they need to be replaced and/or recharged.

In the illustrated embodiment, because suction motor 320*b* is in the base 358 with the electrical cord, it may be an AC motor that can run on AC power received from a wall socket. Motor 320*a* may be operated on DC power supplied by the batteries 405.

In this configuration, a user may be able to select which suction motor 320*a* or 320*b* is to be used when the surface cleaning unit 316 is docked. For example, if performing a small job or if it is desirable to keep the noise level low a user may activate the smaller suction motor 320*a*. Alternatively, if performing a large job a user may select to use the suction motor 320*b* by activating the motor 320*b* and positioning the valve 407 as appropriate.

Dual Operational Mode for a Portable Surface Cleaning Unit

The following is a description of the use of a dual operational mode for a portable surface cleaning unit that may be used by itself in any surface cleaning apparatus or in any combination or sub-combination with any other feature or features disclosed herein.

In accordance with this aspect, a surface cleaning apparatus may have a single suction motor (e.g., a suction motor 320*a* that is provided in the portable cleaning unit 616 which may be as shown in FIG. 23 or surface cleaning unit 116 shown in FIG. 13). which may be operable on current supplied by an on board energy storage member (e.g., batteries 405) when removed from base 358 and may be operable on current supplied from base 358 when mounted thereon. Alternately, or in addition, the base may be provided with a suction motor 320*b* and suction motor 320*b* may also be operable by an on board energy storage member.

Accordingly, when removed from the base 358, motor 320*a* may be operable on DC current supplied from batteries 405. However, when mounted on the base 358 and electrical cord 401 is plugged into an electrical outlet, current may be supplied from base 358 to motor 320*a*. The current may be AC, in which case, motor 320*a* may be operable on both AC and DC current (e.g., it has dual windings) or the AC current may be converted to DC current (such as by providing a power supply in one or both of the base 358 and the surface cleaning unit 116).

Accordingly, for example, as shown in FIG. 17, an electrical connector 408 may be used to connect the portable cleaning unit 616 to the rest of the surface cleaning apparatus such as the base to thereby provide power to the suction motor 320*a* when the surface cleaning apparatus is docked on the base 358. When mounted on the base as exemplified in FIGS. 17 and 22, the suction motor 320*a* may be operable to also run on AC power or a power supply in or on the base. A converter module 409 may be provided to convert the incoming AC power to DC power. The converter module 409 may be provided in or on the base or in the portable cleaning unit 616. Optionally, the convertor module 409 may be in the base 358 so that the connector 408 is with a DC connector.

It will be appreciated that the suction motor of the portable cleaning unit may be operable on different power levels. It may be operable on a first or higher power level when mounted to the base and operable on power supplied from the base (which may be AC or DC). It may be operable on a lower power level when removed from the base.

Figure 25:
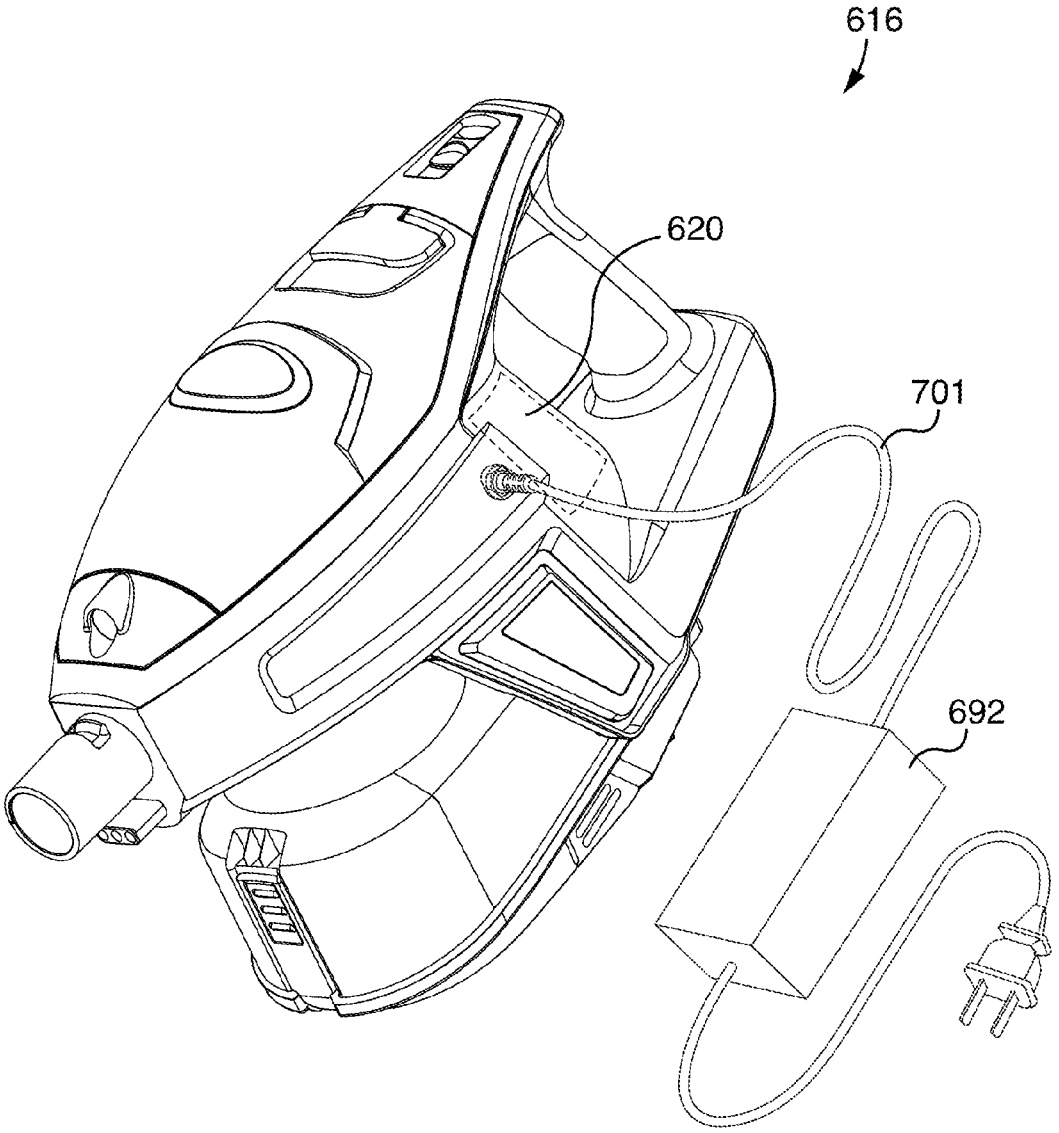
FIG. 25 is a perspective view of the portable cleaning unit of FIG. 23 connected with a power supply and AC power cord.

Reference is now made to FIGS. 22 and 27. In a first operating mode of surface cleaning apparatus 610, portable cleaning unit 616 is mounted to base 658, which includes removable up flow duct 689. As shown, a power cord 701 may be connected to base 658 for delivering power (e.g. AC or DC power) to base 658 for powering upstream suction motor 620*b*, for powering energy storage members 694*b*, or both. Suction motor 620*b* may be an AC suction motor, or a dual windings AC/DC suction motor. Alternatively, upstream suction motor 620*b* may be a DC suction motor. In this case, surface cleaning apparatus 610 may include a power supply 692 (FIG. 25) for converting the AC power from power cord 701 to DC power. The power supply 692 may be positioned inside base 658, or exterior to and connected to base 658 (e.g. by another power cable).

Figure 22A:
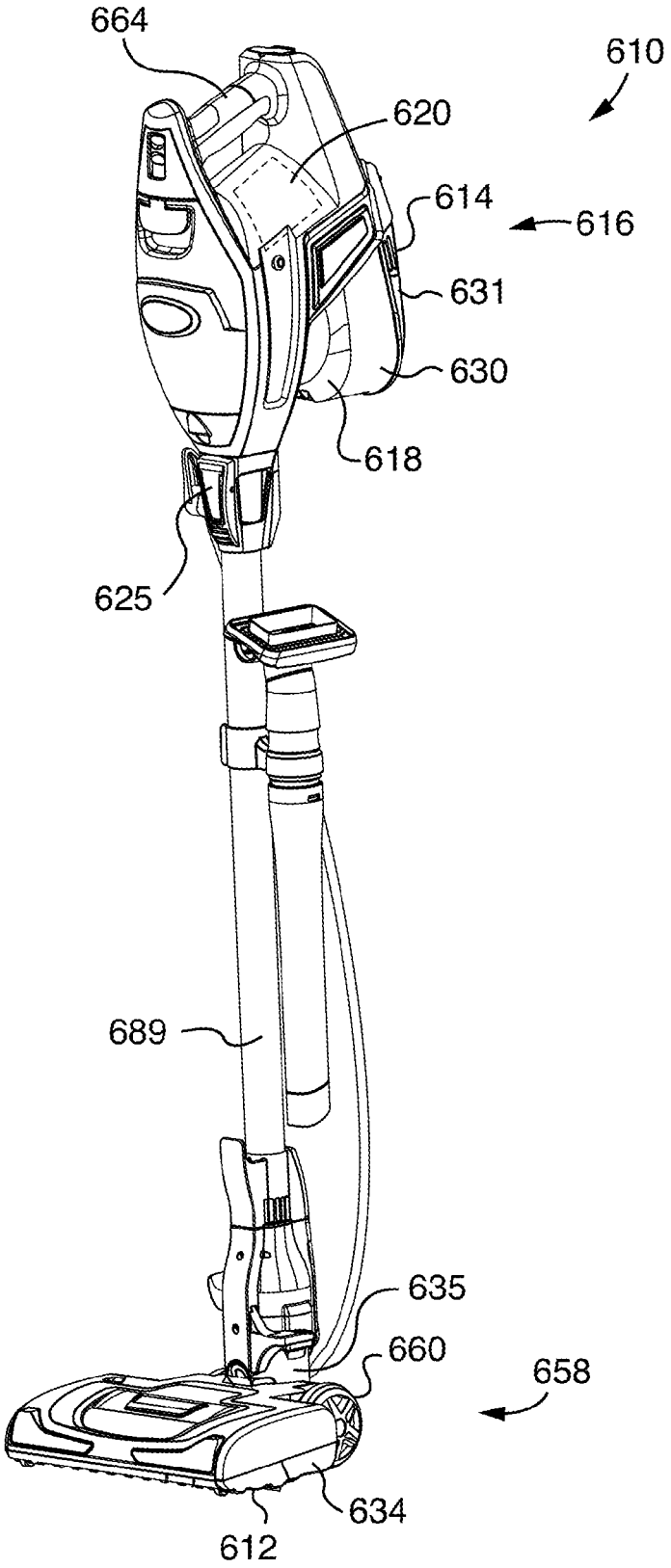
FIG. 22A is a perspective view of the surface cleaning apparatus of FIG. 22 in a cordless configuration.

Alternatively or in addition, suction motor 620*b* may be powered cordlessly (i.e. while power cord 701 is disconnected from base 658) by, e.g., energy storage members 694*b*. For example, FIG. 22A illustrates an embodiment of surface cleaning apparatus 610 in a cordless mode of operation.

In this first operating mode, the upstream suction motor 620*b* may operate while cleaning unit suction motor 620 is turned off (i.e. unpowered). Alternatively, both suction motors 620 and 620*b* may be powered (i.e. turned on), and operated in series to develop enhanced suction. In this case, suction motors 620*b* and/or 620 may be powered by energy storage members 694*b* (e.g. cordlessly), or from the AC power delivered by power cord 701, or both. For example, portable cleaning unit 616 may be electrically connected to base 658 when mounted to base 658 (e.g. by suitable electrical wiring which may be part of up flow duct 689). Base 658 may transmit AC power (e.g. from power cord 701) or DC power (e.g. from energy storage members 694*b*) to portable cleaning unit 616. Similar to upstream suction motor 620*b*, the cleaning unit suction motor 620 may be an AC suction motor, a dual windings AC/DC suction motor, or a DC suction motor. If AC power is delivered to portable cleaning unit 616 and suction motor 620 is a DC suction motor, then portable cleaning unit 616 may include a power supply 692 (FIG. 25) which may be positioned inside portable cleaning unit 616 or exterior to portable cleaning unit 616.

Still referring to the first operating mode, portable cleaning unit 616 and/or base 658 may include energy storage members 694 or 694*b* for powering one or both of suction motors 620 and 620*b* independently of or in addition to power from power cord 701. In this case, power from power cord 701 (optionally converted to DC power by a power supply) may charge energy storage members 694, 694*b* in portable cleaning unit 616, base 658, or both. For example, power from power cord 701 may power suction motor(s) 620 and/or 620*a*, while simultaneously charging energy storage members 694, 694*b* in portable cleaning unit 616, base 658, or both. This may help mitigate the possibility that energy storage members 694, 694*b* have insufficient charge when power cord 701 is disconnected (e.g. unplugged) from the wall outlet or disconnected (e.g. unplugged) from surface cleaning apparatus 610.

Figure 27A:
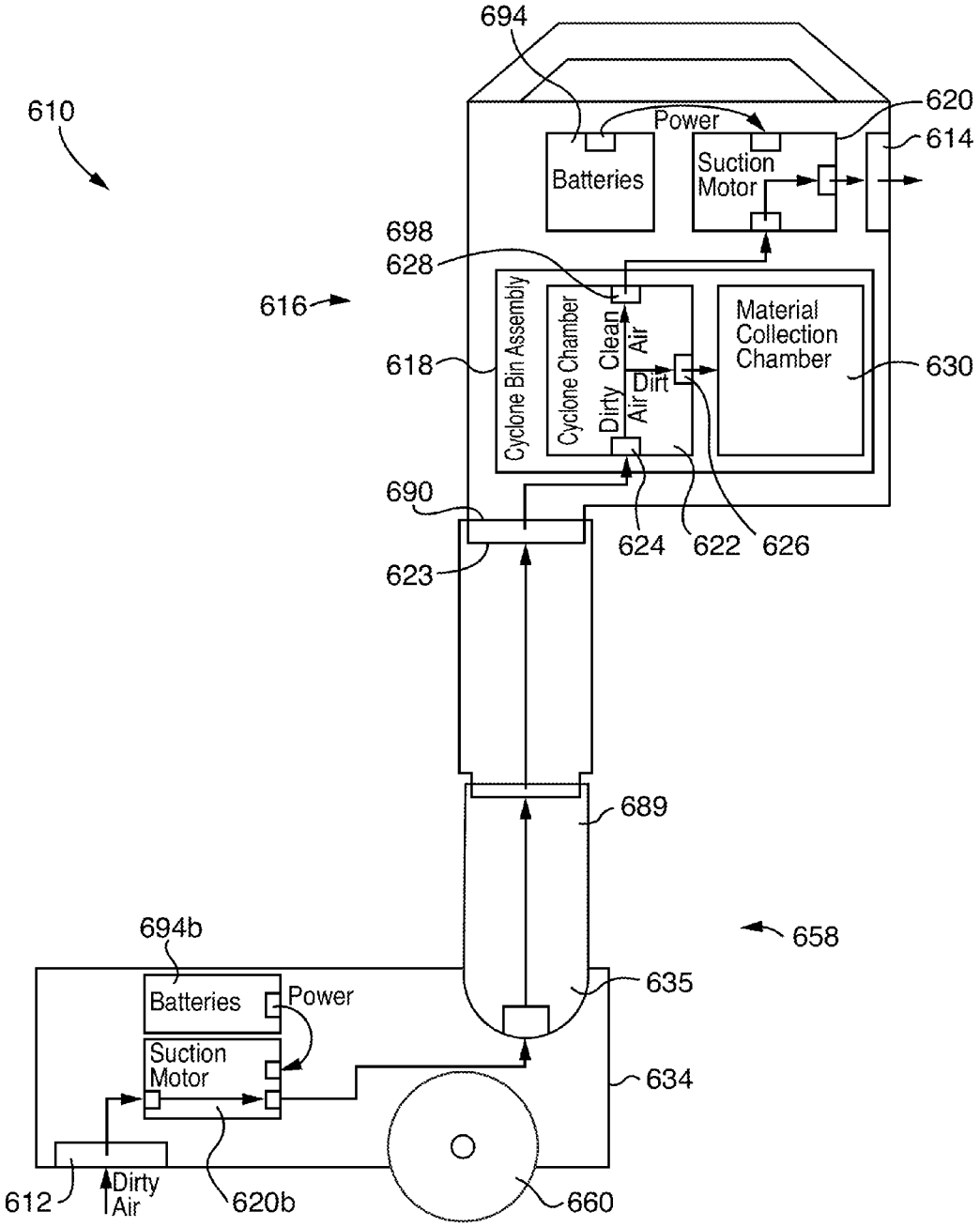
FIG. 27A is a schematic drawing of another embodiment of the surface cleaning apparatus of FIG. 22 absent a power cord connections.

FIG. 27A exemplifies a further embodiment, in which surface cleaning unit 616 is not electrically connectable to an external source of power (e.g. is free of connectors for connection to a power cord). For example, energy storage members 694 may be removable from surface cleaning unit 616 for connection to an external source of power for charging (e.g. by inserting the portable cleaning unit 616 and/or energy storage member 694 in a charging dock).

In some embodiments portable cleaning unit 616 is itself not directly electrically connectable to an external source of power (e.g. it may not have a power cord and may not have a connector to which an external power cord may be connected). In such a case, energy storage member 694 may be charged when portable cleaning unit 616 is mounted to a base and/or by inserting the portable cleaning unit 616 and/or energy storage member 694 in a charging dock.

Still referring to the first operating mode and FIGS. 22 and 27, the power cord 701 may be connected to surface cleaning apparatus 610 at a location above base 658 (e.g. on up flow duct 689 proximate portable cleaning unit 616 and/or on portable cleaning unit 616). For example, power cord 701 may be electrically connected directly to base 658, and run upwardly on up flow duct 689 and may be secured to the exterior thereof such as by one or more mounting clips (obscured from view). This may help keep power cord 701 from dragging on the floor behind base 658 during use. Alternatively or in addition, up flow duct 689 may include a power connector 691 which mates with power cord connector 698 (obscured from view in FIG. 22, but may be similar to power cord connector 698 of FIG. 26). In this case, up flow duct 689 may include suitable electrical wiring for delivering the power from power cord 701 to base 658, portable cleaning unit 616, or both.

Still referring to FIGS. 22 and 27, surface cleaning apparatus 610 may be operable in a second cleaning mode, as an alternative to or in addition to the first cleaning mode. The second cleaning mode is similar to the first cleaning mode, except that power cord 701 is directly electrically connected to portable cleaning unit 616, and power may be transmitted from portable cleaning unit 616 to base 658 if base contains an electrically operable member such as a brush motor and/or a suction motor. As in the first cleaning mode, a power supply 692 (FIG. 25) may be positioned exterior to or inside of surface cleaning apparatus 610 (e.g. inside or exterior to base 658, portable cleaning unit 616, or both) for converting the AC power to DC power. Each of suction motors 620 and 620*b* may be AC, DC, or dual windings AC/DC. Upstream suction motor 620*b* may be powered exclusively of suction motor 620, or both suction motors 620 and 620*b* may be powered simultaneously. Energy storage members 694, 694*b* (if present) in base 658, portable cleaning unit 616, or both may be charged by the power from power cord 701. It will be appreciated that the energy storage members may be charged while power cord 701 is connected to an AC outlet and the portable cleaning unit 616.

The second cleaning mode may permit power from power cord 701 to supply power to portable cleaning unit 616 uninterrupted by disconnection of the portable cleaning unit 616 from base 658. This may permit uninterrupted operation when transitioning between the second cleaning mode and an above-floor or handvac cleaning mode (or vice versa), especially where the portable cleaning unit 616 has no energy storage members 694.

Still referring to FIGS. 22 and 27, surface cleaning apparatus 610 may be operable in a third cleaning mode, as an alternative to or in addition to any of the first and second cleaning modes. The third cleaning mode is similar to the first cleaning mode, except that upstream suction motor 620*b* is not powered or is not present. That is, power from power cord 701 is delivered to base 658, and then transmitted to portable cleaning unit 616 to power suction motor 620. As in the first cleaning mode, a power supply 692 (FIG. 25) may be positioned exterior to or inside of surface cleaning apparatus 610 (e.g. inside or exterior to base 658, portable cleaning unit 616, or both) for converting the AC power to DC power. Suction motor 620 may be AC, DC, or dual windings AC/DC. Energy storage members 694, 694*b* (if present) in base 658, portable cleaning unit 616, or both may be charged by the power from power cord 701.

Referring to FIGS. 23-25 and FIG. 29, surface cleaning apparatus 610 may be operable in a fourth cleaning mode, as an alternative to or in addition to any of the first, second, and third cleaning modes. In the fourth cleaning mode, portable cleaning unit 616 is disconnected from base 658 and operable as a hand-held cleaning apparatus (e.g. handvac). As shown, power cord 701 may be connected to portable cleaning unit 616 for powering suction motor 620. As in the first cleaning mode, suction motor 620 may be an AC suction motor, a dual windings AC/DC suction motor, or a DC suction motor. A power supply 692 may be positioned inside or exterior to portable cleaning unit 616 for converting AC power from power cord 701 to DC power. Alternatively, power cord 701 may include a DC power connector 702 (e.g. cigarette lighter connector) for directly delivering DC power to portable cleaning unit 616. Energy storage members 694 (FIG. 29) (if present) in portable cleaning unit 616 may be charged by the power from power cord 701.

Figure 26:
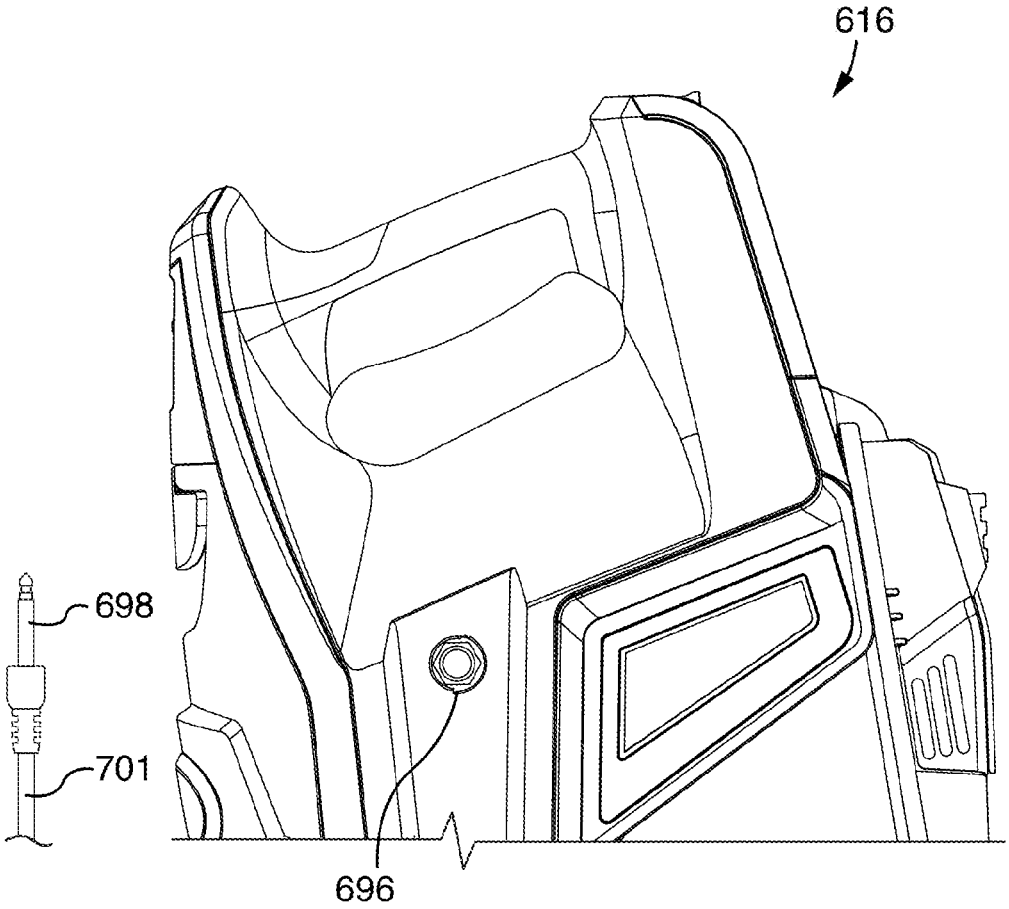
FIG. 26 is a partial side view of the portable cleaning unit of FIG. 23 disconnected from a power cord.
Figure 29:
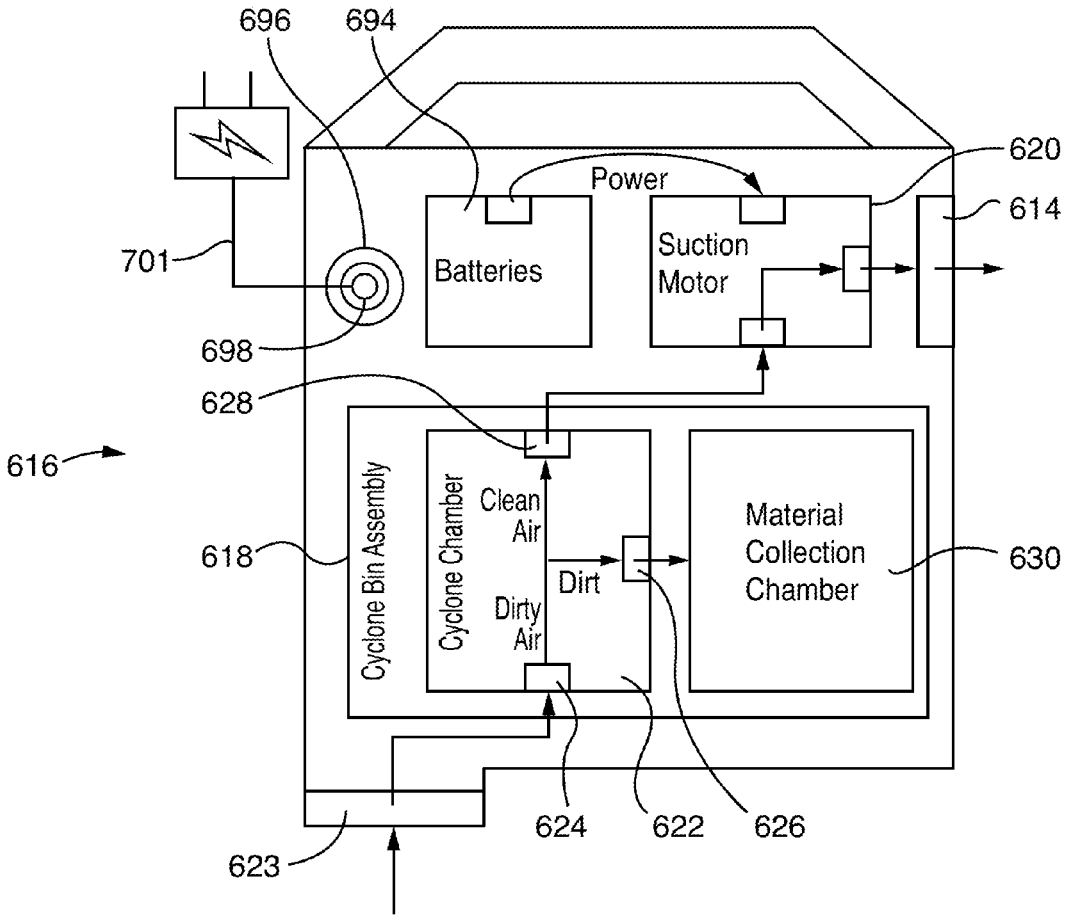

Referring to FIGS. 23, 26, and 29, surface cleaning apparatus 610 may be operable in a fifth cleaning mode, as an alternative to or in addition to any of the first, second, third, and fourth cleaning modes. The fifth cleaning mode is similar to the fourth cleaning mode, except that power is not provided by power cord 701. For example, power cord 701 may be disconnected from the external power source (e.g. disconnected from an AC wall outlet or 12V DC source), and/or power cord 701 may be disconnected from portable cleaning unit 616 (FIG. 26). Instead, suction motor 620 is powered by energy storage members 694 in portable cleaning unit 616.

It will be appreciated that certain features of the invention, which are, for clarity, described in the context of separate embodiments or separate aspects, may also be provided in combination in a single embodiment. Conversely, various features of the invention, which are, for brevity, described in the context of a single embodiment or aspect, may also be provided separately or in any suitable sub-combination.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A surface cleaning apparatus comprising:

a) a surface cleaning head having a first dirty fluid inlet;

b) an upright section moveably mounted to the surface cleaning head between an storage position and a reclined in use position;

c) a portable cleaning unit removably mounted to the upright section and comprising at least one air treatment member, a first energy storage member and a portable cleaning unit suction motor; and, d) a fluid flow path extending from the first dirty fluid inlet to the portable cleaning unit, wherein at least one of the surface cleaning head, the upright section and the portable cleaning unit is connectable to an external source of power, the portable cleaning unit suction motor is operable on power provided by the first energy storage member when removed from the upright section and is operable on power provided by the external source of power when mounted to the upright section.

2. The surface cleaning apparatus of claim 1 wherein the portable cleaning unit suction motor is operable on DC power.

3. The surface cleaning apparatus of claim 1 wherein one of the surface cleaning head and the upright section further comprises or is connectable to a power cord and the portable cleaning unit is powered solely by the first energy storage member when the portable cleaning unit is removed from the upright section.

4. The surface cleaning apparatus of claim 1 wherein one of the surface cleaning head and the upright section further comprises or is connectable to a power cord, the first energy storage member comprises one or more battery and the one or more battery is charged when the portable cleaning unit is mounted on the upright section.

5. The surface cleaning apparatus of claim 1 wherein the upright section is an up flow duct and the portable cleaning unit is a hand vacuum cleaner.

6. The surface cleaning apparatus of claim 1 wherein the portable cleaning unit suction motor is operable on DC power and the upstream suction motor is operable on AC power.

7. The surface cleaning apparatus of claim 6 wherein the portable cleaning unit suction motor is a dirty air motor and the upstream suction motor is a clean air motor.

8. The surface cleaning apparatus of claim 1, wherein the portable cleaning unit further comprises or is connectable to a power cord and the portable cleaning unit suction motor is also operable on power provided by the external source of power when removed from to the upright section.

* * * * *